US010900640B2

(12) United States Patent
Xia et al.

(10) Patent No.: US 10,900,640 B2
(45) Date of Patent: Jan. 26, 2021

(54) LAMP HOLDER ROTATING ASSEMBLY AND ILLUMINATING APPARATUS

(71) Applicant: SHENZHEN ROYOLE TECHNOLOGIES CO. LTD., Guangdong (CN)

(72) Inventors: Xinyuan Xia, Guangdong (CN); Wenjun Liu, Guangdong (CN)

(73) Assignee: SHENZHEN ROYOLE TECHNOLOGIES CO. LTD., Shenzhen (CN)

( * ) Notice: Subject to any disclaimer, the term of this patent is extended or adjusted under 35 U.S.C. 154(b) by 281 days.

(21) Appl. No.: 16/095,746

(22) PCT Filed: Sep. 30, 2016

(86) PCT No.: PCT/CN2016/101335
§ 371 (c)(1),
(2) Date: Oct. 23, 2018

(87) PCT Pub. No.: WO2018/058643
PCT Pub. Date: Apr. 5, 2018

(65) Prior Publication Data

US 2020/0332986 A1 Oct. 22, 2020

(51) Int. Cl.
*F21V 21/30* (2006.01)
*F21V 14/02* (2006.01)
(Continued)

(52) U.S. Cl.
CPC ..... *F21V 14/02* (2013.01); *F21S 6/003* (2013.01); *F21V 17/005* (2013.01); *F21V 21/26* (2013.01); *F21V 21/30* (2013.01); *F21Y 2115/10* (2016.08)

(58) Field of Classification Search
CPC ..... F21V 14/02; F21V 21/26; F21V 21/30; F21V 17/005; F21L 4/02; F21S 6/003
See application file for complete search history.

(56) References Cited

U.S. PATENT DOCUMENTS 9,719,641 B1 * 8/2017 Volek ..... F21V 23/02
2009/0109679 A1 4/2009 Ko et al.
(Continued)

FOREIGN PATENT DOCUMENTS

CN 101852361 A 10/2010
CN 201964358 U 9/2011
(Continued)

OTHER PUBLICATIONS

International search report dated Jun. 30, 2017 from corresponding application No. PCT/CN2016/101335.

*Primary Examiner* — Isiaka O Akanbi
*Assistant Examiner* — Nathaniel J Lee
(74) *Attorney, Agent, or Firm* — Hauptman Ham, LLP

(57) ABSTRACT

The present disclosure provides a lamp holder rotating assembly, comprising a foundation support, an inserted rod, and a rotating head. The foundation support defines a locating slot. The inserted rod comprises a head end and a tail end coupled to the head end. The rotating head defines a groove. The inserted rod is rotatably mounted on the foundation support. The tail end passes through the locating slot. The head end passes through the groove of the rotating head. The head end rotates in the groove along a first direction which causes the tail end rotating in the locating slot along a second direction opposite to the first direction. The present disclosure further provides an illuminating apparatus.

18 Claims, 29 Drawing Sheets

(51) Int. Cl.

| | |
|---|---|
| ***F21S 6/00*** | (2006.01) |
| ***F21V 17/00*** | (2006.01) |
| ***F21V 21/26*** | (2006.01) |
| *F21Y 115/10* | (2016.01) |

(56) References Cited

U.S. PATENT DOCUMENTS

| | | | | |
|---|---|---|---|---|
| 2010/0118538 | A1 | 5/2010 | Kay | |
| 2013/0301270 | A1* | 11/2013 | Ng | F21V 21/26 362/249.03 |

FOREIGN PATENT DOCUMENTS

| | | | |
|---|---|---|---|
| CN | 202709031 | U | 1/2013 |
| CN | 103868033 | A | 6/2014 |
| CN | 103868034 | A | 6/2014 |
| CN | 205048227 | U | 2/2016 |

* cited by examiner

LAMP HOLDER ROTATING ASSEMBLY AND ILLUMINATING APPARATUS

RELATED APPLICATIONS

The present application is a National Phase of International Application Number PCT/CN2016/101335, filed Sep. 30, 2016.

TECHNICAL FIELD

This disclosure relates to illuminating apparatus connection technology fields, and more particularly relates to a lamp holder rotating assembly and an illuminating apparatus.

BACKGROUND

Generally, a lamp holder of an illuminating apparatus is fixed to a base of the illuminating apparatus. The illuminating apparatus is placed on a position of a desk or a bedside, used for illuminating and convenient for switching. However, a light emitting angle of the illuminating apparatus is fixed, when the user needs to adjust the light emitting angle of the illuminating apparatus, it is inconvenient to move entire of the illuminating apparatus.

SUMMARY

Embodiments of the present disclosure disclose a lamp holder rotating assembly, which is convenient to adjust a direction of a lamp holder.

The present disclosure provides a lamp holder rotating assembly. The lamp holder rotating assembly includes a foundation support, an inserted rod and a rotating head. The foundation support defines a locating slot. The inserted rod includes a head end and a tail end coupled to the head end. The rotating head defines a groove. The tail end passes through the locating slot. The head end passes through the groove of the rotating head. The head end rotates in the groove along a first direction which causes the tail head rotating in the locating slot along a second direction opposite to the first direction.

The present disclosure provides an illuminating apparatus. The illuminating apparatus includes a base, a lamp post mounted to the base, a lamp holder, and the lamp holder rotating assembly. The lamp holder is rotatablely mounted to the lamp post through the lamp holder rotating assembly.

The lamp holder rotating assembly of the present disclosure is used to couple the lamp holder of the illuminating apparatus to the lamp post of the illuminating apparatus to realize a rotation of the lamp holder and facilitate the adjustment of the light emitting angle of the lamp holder.

BRIEF DESCRIPTION OF THE ACCOMPANYING DRAWINGS

To describe technology solutions in the embodiments of the present disclosure more clearly, the following briefly introduces the accompanying drawings required for describing the embodiments. Obviously, the accompanying drawings in the following description show merely some embodiments of the present disclosure, those of ordinary skill in the art may also derive other obvious variations based on these accompanying drawings without creative efforts.

DETAILED DESCRIPTION OF ILLUSTRATED EMBODIMENTS

The technical solution in the embodiments of the present disclosure will be described clearly and completely hereinafter with reference to the accompanying drawings in the embodiments of the present disclosure.

Figure 1:
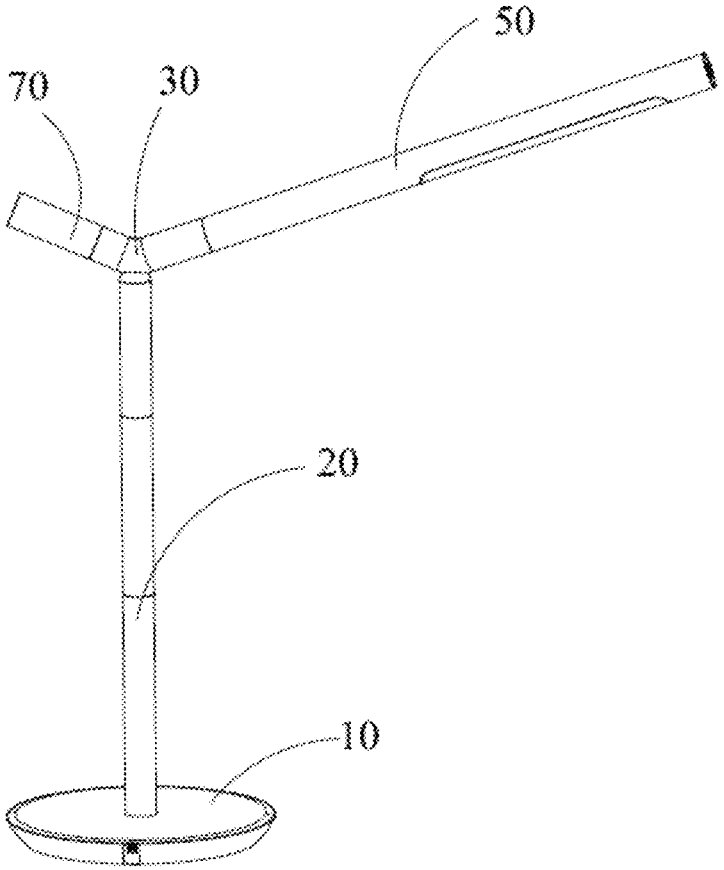
FIG. 1 is a perspective diagram of an illuminating apparatus of the present disclosure.
Figure 2:
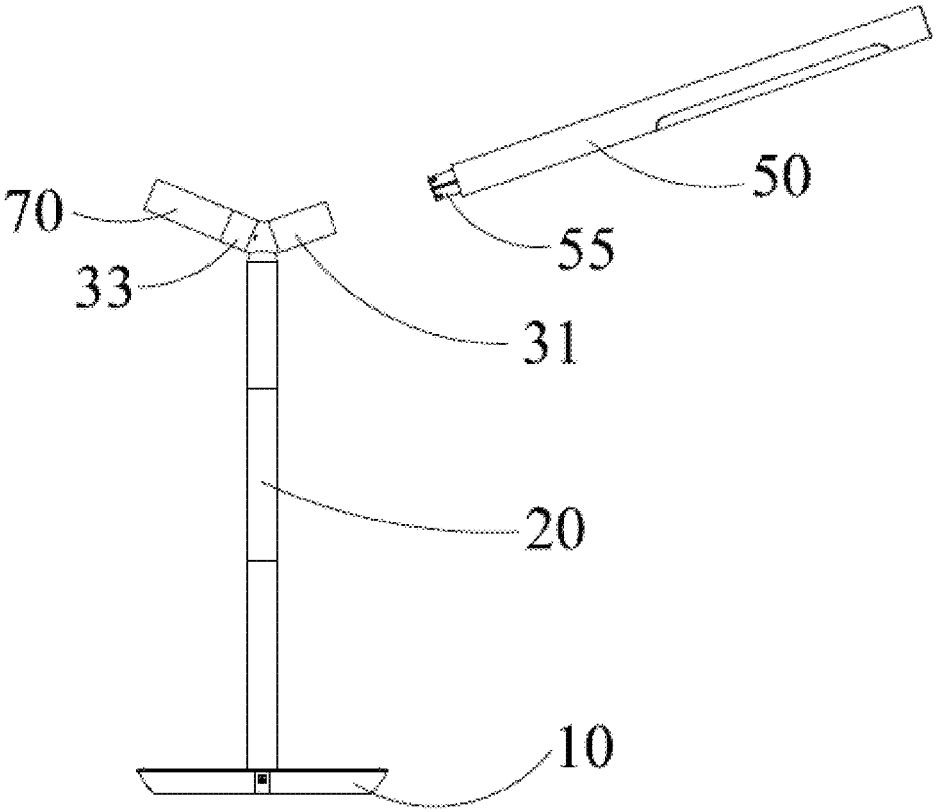
FIG. 2 is a diagram of a first lamp holder of the illuminating apparatus shown in FIG. 1 separated from a stand.
Figure 3:
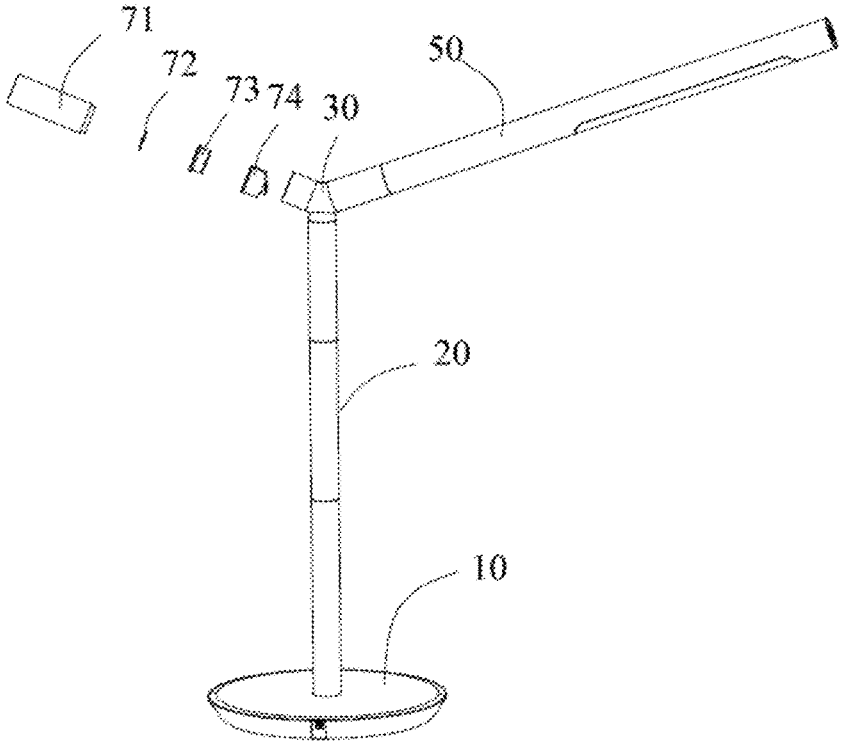
FIG. 3 is an exploded diagram of a second lamp holder of the illuminating apparatus shown in FIG. 1, and the second lamp holder is separated from a stand.

Referring to FIGS. 1 to 3, an illuminating apparatus described in the present disclosure is a table lamp. The illuminating apparatus includes a base 10, a lamp post 20, a first lamp holder 50 and a second lamp holder 70. The first lamp holder 50 and the second lamp holder 70 work cooperatively to provide illumination. Wherein, the second lamp holder 70 is off when the first lamp holder 50 is on, and the second lamp holder 70 is on when the first lamp holder 50 is off. A brightness of the first lamp holder 50 is greater than that of the second lamp holder 70. The lamp post 20 includes a stand 30 that couples the first lamp holder 50 and the second lamp holder 70. The lamp post 20 is mounted on the base 10. The stand 30 is mounted on an end portion of the lamp post 20. The first lamp holder 50 is detachably mounted on one end of the stand 30, and the second lamp holder 70 is mounted on the other end of the stand 30. The first lamp holder 50 and the second lamp holder 70 may follow a rotation of the stand 30. The lamp post 20 includes electronic components. When the first lamp holder 50 is plugged into the stand 30, the first lamp holder 50 is electrically coupled to the electronic components. The first lamp holder 50 is detachably coupled to the stand 30, and may be used as a separate lamp after being disassembled, and is mounted on the lamp post 20 as a light source of the illuminating apparatus. The illuminating apparatus further includes a control module located below the stand 30. The control module is electrically coupled to the first lamp holder 50 and the second lamp holder 70.

Figure 4:
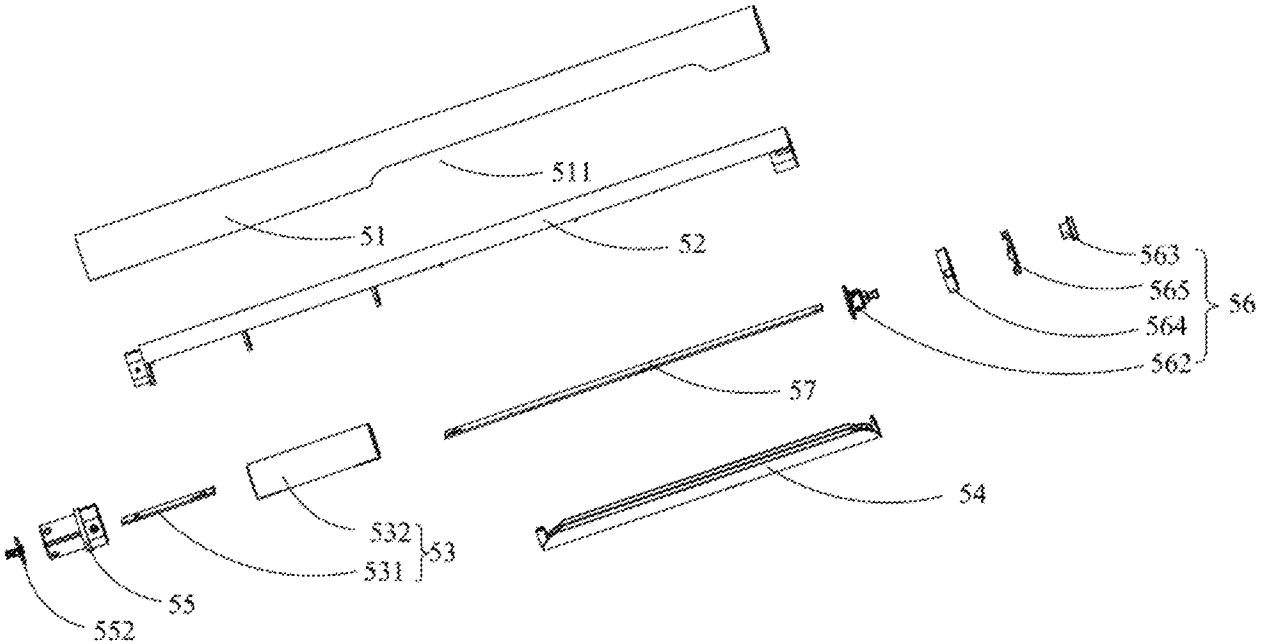
FIG. 4 is an exploded diagram of the first lamp holder shown in FIG. 2.
Figure 7:
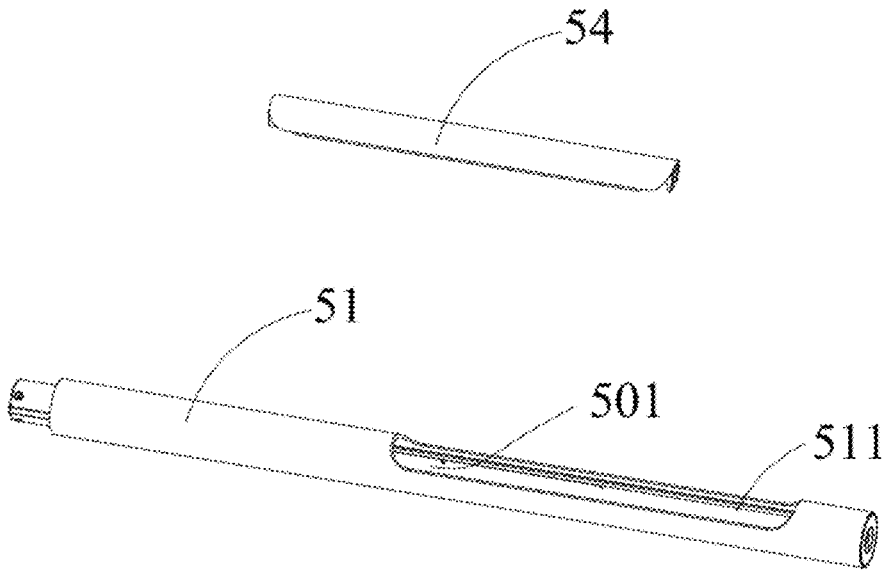
FIG. 7 is an exploded diagram of a lamp housing and a lamp cover shown in FIG. 4.

The first lamp holder 50 is an illuminating lamp holder. Referring to FIG. 4, the illuminating lamp holder includes a lamp housing 51, a lamp support 52 and a switch assembly 56. The lamp housing 51 includes a port and a cavity 501 (as shown in FIG. 7) interconnected with the port. The lamp support 52 inserts into the cavity 501 of the lamp housing 51, such that the lamp housing 51 is sleeved on the lamp support 52. The switch assembly 56 is disposed in the port and further makes the lamp support 52 closed in the cavity. The first lamp holder 50 also includes a first control module. The electronic components of the lamp post 20 include a second control module (ie, the control module mentioned above). When the first lamp holder 50 is removed from the stand 30, the first control module independently controls a light source to work. When the first lamp holder 50 is mounted on the stand 30, the first control module work cooperatively with the second control module to control the light source to work. The switch assembly 56 controls the light source on/off by controlling the first control module. The specific implementations are as follows:

In this embodiment, the first lamp holder 50 includes another control module (ie, the first control module). When the first lamp holder 50 is mounted on the stand 30, the control module is electrically coupled to the another control module, and the another control module works independently when the first lamp holder is removed from the stand 30. The first lamp holder 50 includes the lamp housing 51, the lamp support 52, and the switch assembly 56, and further includes a power supply module 53, a lamp cover 54, a connector 55, and a light source. The lamp cover 54 is mounted on the lamp housing 51. The lamp support 52 is inserted into the lamp housing 51. The light source includes a first circuit board 57 and a plurality of LED lights arranged on the first circuit board 57. The power supply module 53 includes a second circuit board 531 and a battery 532 of the first control module (ie, the other control module). When the first lamp holder 50 is mounted on the stand 30, the battery 532 supplies power to the second lamp holder 70. The battery 532 is electrically coupled to the first circuit board 57 and the second circuit board 531.

Figure 8:
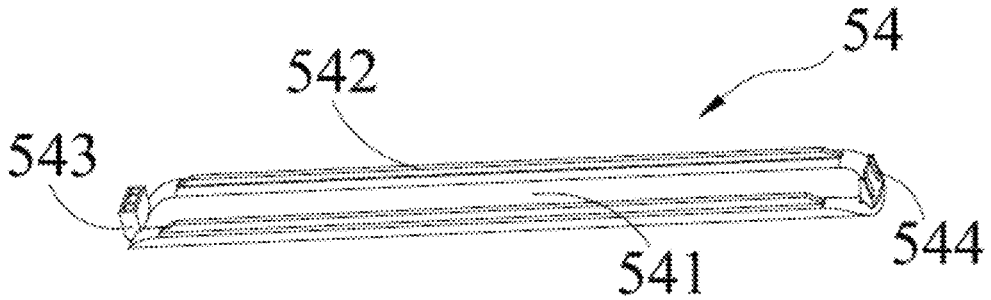
FIG. 8 is a schematic diagram of the lamp cover of FIG. 7 seen from another angle.
Figure 9:
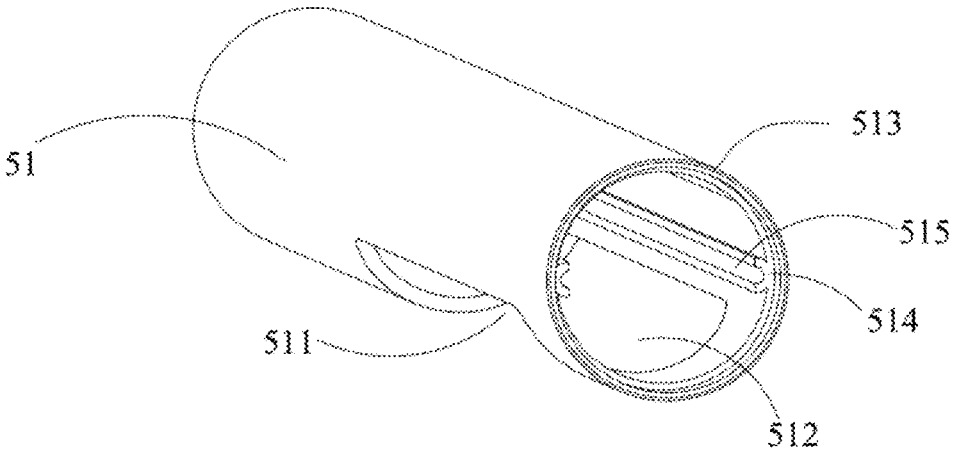
FIG. 9 is a schematic diagram of a lamp housing of FIG. 4 seen from an angle.

Referring to FIGS. 4, 7 and 9, the lamp housing 51 has a tubular structure and forms the cavity 501, and can be integrally manufactured with metal materials. The lamp housing 51 defines a window 511. The lamp housing 51 further includes an inner peripheral wall 512 and two opposite end portions 513. One part of an inner peripheral wall 512 of the lamp housing 51 close to the port forms the port, that is, the port is defined on the end portion 513. A rib 514 is formed on the inner peripheral wall 512 of the lamp housing 51. A first fixing groove 515 is defined on the rib 514. In detail, the rib 514 is convexly deposed at the inner peripheral wall 512 of the lamp housing 51 along an axial direction of the lamp housing 51, and located at two ends of the lamp housing 51. The first fixing groove 515 is defined along an extending direction of the rib 514. The lamp cover 54 is mounted on the window 511, such that the light source of the LED lights achieves an illumination of the first lamp holder 50. The lamp housing 51 further includes a stepper surrounding the rib 514 and coupled with the rib 514. Referring to FIGS. 7 and 8, the lamp cover 54 includes a holding structure, and the holding structure engages with a window edge so as to mount the lamp cover 54 on the window 511. The lamp cover 54 is an elongated body and includes an arc-shaped light transmitting plate 541, two protrusions 542 located on opposite sides of the light transmitting plate 541, and an engaging block 543 and an engaging piece 544 located at opposite ends of the light transmitting plate 541. The shape and the structure of the engaging block 543 and the engaging piece 544 are different. The engaging block 543, the protrusions 542 and the engaging piece 544 constitute the holding structure and are located towards a same direction, and engage with edges of the window 511 respectively, such that the lamp cover 54 is mounted on the lamp housing 51. The connecting positions of the engaging block 543, the engaging piece 544 and the light transmitting plate 541 are recessed inwards to form an engaging groove, and opposite edges of the window 511 are engaged in the engaging groove. Since the lamp housing 51 and the lamp cover 54 use no screws, it is more convenient to disassemble and assemble, and does not affect an appearance of the first lamp holder 50.

Figure 5:
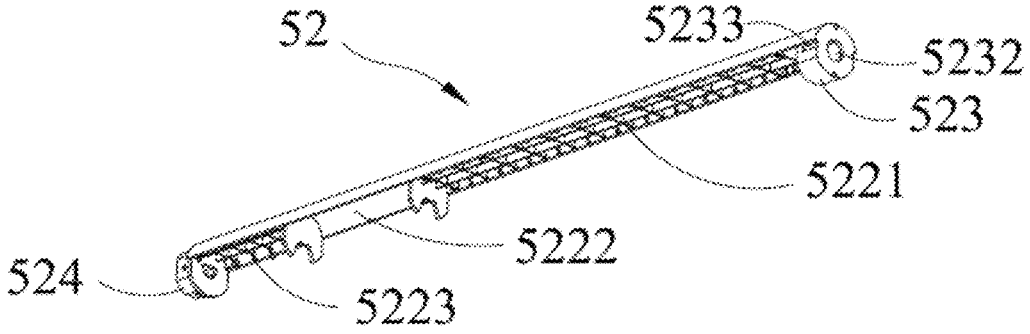
FIG. 5 and FIG. 6 are schematic diagrams of a lamp support of the first lamp holder shown in FIG. 4 at two different angles.
Figure 6:
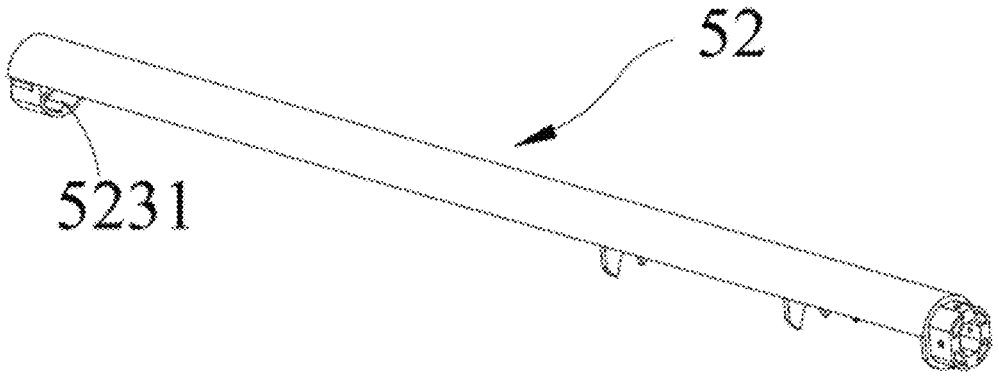

Referring to FIGS. 5 and 6, the lamp support 52 includes a first end cover 523 and a second end cover 524 disposed opposite to each other. The switch assembly 56 abuts the first end cover 523. The first end cover 523 is located in the lamp support 52, and the second end cover 524 is also located in the lamp support 52. The switch assembly 56 includes a collar 564 received in the port. The collar 564 abuts end faces of the rib 514 and the first end cover 523.

Figure 11:
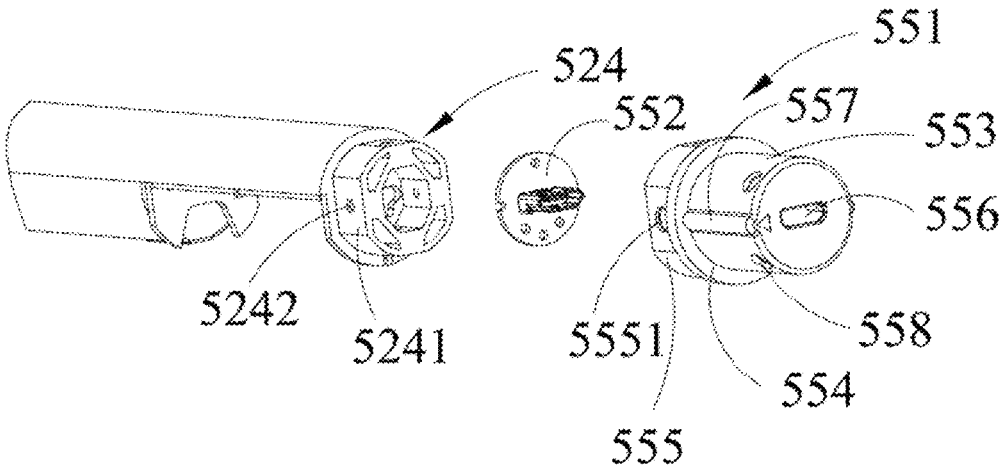
FIG. 11 is an exploded diagram of a connector, an interface and a lamp support of the first lamp holder shown in FIG. 2.

In detail, the lamp support 52 is a semi-circular pipe body that is inserted and received in the lamp housing 51. The first end cover 523 and the second end cover 524 are located at opposite ends of an arc-shaped inner surface of the lamp support 52. A light source groove 5221, a battery groove 5222, and an accommodating groove 5223 are sequentially defined on the inner surface. The light source groove 5221 is used for receiving the first circuit board 57 with the LED lights. The battery groove 5222 is used for receiving the battery 532. The accommodating groove 5223 is used for receiving the second circuit board 531. The first end cover 523 is located at one end of the light source groove 5221. The second end cover 524 is located at one end of the accommodating groove 5223. The first end cover 523 has a cylindrical shape, and defines a cavity 5231 towards the inner surface. And a circular hole 5232 is defined in a middle of the first end cover 523. The cavity 5231 and the circular hole 5232 are used for mounting a switch 562 of the switch assembly 56. The first end cover 523 defines a second fixing groove 5233 on an outer surface thereof. The first fixing groove 515 and the second fixing groove 5233 cooperatively form a screw hole for a screw passing through. Opposite ends of each first fixing groove 515 and each second fixing groove 5233 and one side between the opposite sides are open. The first fixing groove 515 and the second fixing groove 5233 are semicircular grooves in cross section. Referring to FIG. 11, the second end cover 524 has a convex, hollow, and cylindrical shape. The outer peripheral face 5241 of the second end cover 524 includes two pairs of planes of which each two planes are opposite to each other, and each plane defines a screw hole 5242.

Figure 10:
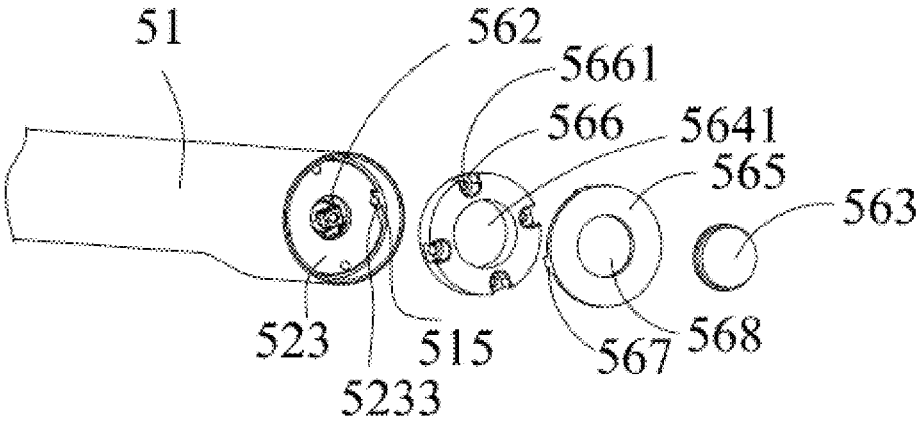
FIG. 10 is an exploded diagram of a button, a lamp housing, and a lamp support of the first lamp holder shown in FIG. 2.

As shown in FIG. 10, the switch assembly 56 includes the switch 562 mounted on the first circuit board 57, a button 563 coupled with the switch 562, a collar 564, and a panel 565. The switch 562 is exposed at the end face of the first end cover 523. The button 563 is coupled to the switch 562. The collar 564 surrounds the button 563. In detail, the collar 564 includes a circular hole 5641 and a plurality of avoidance slots 566 defined all around the collar 564. The avoidance slot 566 is used to receive screws that lock the lamp housing 51 and the lamp support 52. A through hole 5661 is further defined at a bottom of the avoidance slots 566, for a screw passing through and further locking between the first end cover 523 and the lamp housing 51 to lock the collar 564. The collar 564 also abuts an end face of the stepper. The panel 565 is a ring sheet. The panel 565 includes a protrusion 567 opposite to the avoidance slot 566. A mounting hole 568 is disposed in a middle of the panel 565. The mounting hole 568 and the circular hole 5641 together receive the button 563. The protrusion 567 is engaged with the avoidance slot 566 so as to fix the panel 565 and the collar 564.

Referring to FIG. 11, the connector 55 includes a main body 551 and an interface 552. The main body 551 is substantially a hollow cylinder having a stepped shape. The main body 551 includes a convex column 553, a convex ring 554, and an annulus 555 coupled in sequence. An opening 556 is defined in an end portion of the convex column 553 away from the convex ring 554 for the interface 552 reaching out. A rib flange 557 and a circular groove 558 are formed on an outer peripheral surface of the convex column 553. The convex ring 554 is located along an axial direction of the convex column 553, and an end of the rib flange 557 terminates on the convex ring 554. The rib flange 557 is used for mounting with the stand 30. A plurality of the circular grooves 558 are defined on an outer peripheral face of the convex column 553 around the axial direction of the convex column 553. Each circular groove 558 is equipped with a rollable ball (not shown). An end portion of the annulus 555 away from the convex ring 554 is an open end of the main body 551, for receiving the interface 552 in the main body 551. A through hole 5551 is defined on a peripheral wall of the annulus 555 with respect to the screw hole 5242 of the second end cover 524 for the screw passing through, so as to fix the connector 55 to the second end cover 524.

Referring to FIG. 10, the lamp housing 51 is sleeved on the lamp support 52. The first end cover 523 and the second end cover 524 are located at two end portions 513 of the lamp housing 51. The first fixing groove 515 and the second fixing groove 5233 are interconnected with each other to form a thread hole having a circular cross section. An end face of the first end cover 523 and a peripheral wall of the end portion of the lamp housing 51 form a concave portion, which is used for accommodating the switch assembly 56. The switch 562 is received in the cavity 5231 of the first end cover 523 and electrically coupled to the first circuit board 57. The collar 564 abuts the end face of the first end cover 523 and covers the concave portion. The through hole 5661 of the avoidance slot 566 is corresponding to the thread hole. The screw is threaded through the through hole 5661 to threadably fix the first end cover 523 and the lamp housing 51. The button 563 is received in the circular hole 5641 of the collar 564 and the mounting hole 568 of the panel 565, and is further limited by the mounting hole 568. The button 563 abuts with the switch 562 to control the switch 562. The panel 565 covers the screw and the thread hole, such that an appearance of the first lamp holder 50 looks intact. The collar 564 serves as a spacer that simultaneously abuts against a front surface of the rib 514 of the lamp housing 51 and a front surface of the first end cover 523 of the lamp support 52, thereby preventing the lamp housing 51 from being pulled out of the lamp support 52. The screws further lock the collar 564, the lamp support 52 and the lamp housing 51. When it necessary to disassemble, what is to do is simply unscrew the screws and remove the collar 564 and the panel 565, the lamp housing 51 can be then removed from the lamp support 52. The process is relatively simple.

The second end cover 524 is located within the end portion of the lamp housing 51. The distance of the second end cover 524 from the nearest end portion 513 of the lamp housing 51 is less than the distance of the first end cover 523 from the nearest end portion 513 of the lamp housing 51. The connector 55 is mounted on the second end cover 524, and is sleeved to the outer peripheral face 5241 of the second end cover 524 through the open end of one end of the annulus 555. The screw hole 5242 is opposite to the through hole 5551 and is fixedly coupled by the screw so as to enclose the interface 552 of the connector 55 in the main body 551. Since an inner circumferential surface of the annulus 555 includes two opposite planes, an outer circumferential surface of one end of the lamp support 52 also includes two opposite planes 5241, so when the annulus 555 is sleeved on the lamp support 52, the two planes of the annulus 555 are abutted with the two planes 5241 of the lamp support 52 respectively, so as to achieve the positioning of the two. The interface 552 extends through the opening 556 for coupling a plug that is electrically coupled thereto. The lamp housing 51 is integrally manufactured with metal materials. Therefore, the lamp housing 51 is an integral part seen from outside, and fixing members such as screws are not visible to naked eyes, so that an overall visual effect is better. Also, no screws are exposed to the outside and it is possible to prevent the screws from rusting and being unable to be removed after prolonged exposure. Further, the collar 566 and the screws can prevent the user from inadvertently pulling the lamp housing 51 out of the lamp support 52. One end of the lamp housing 51 abuts on the convex ring 554 of the connector 55 to prevent detachment.

Figure 40:
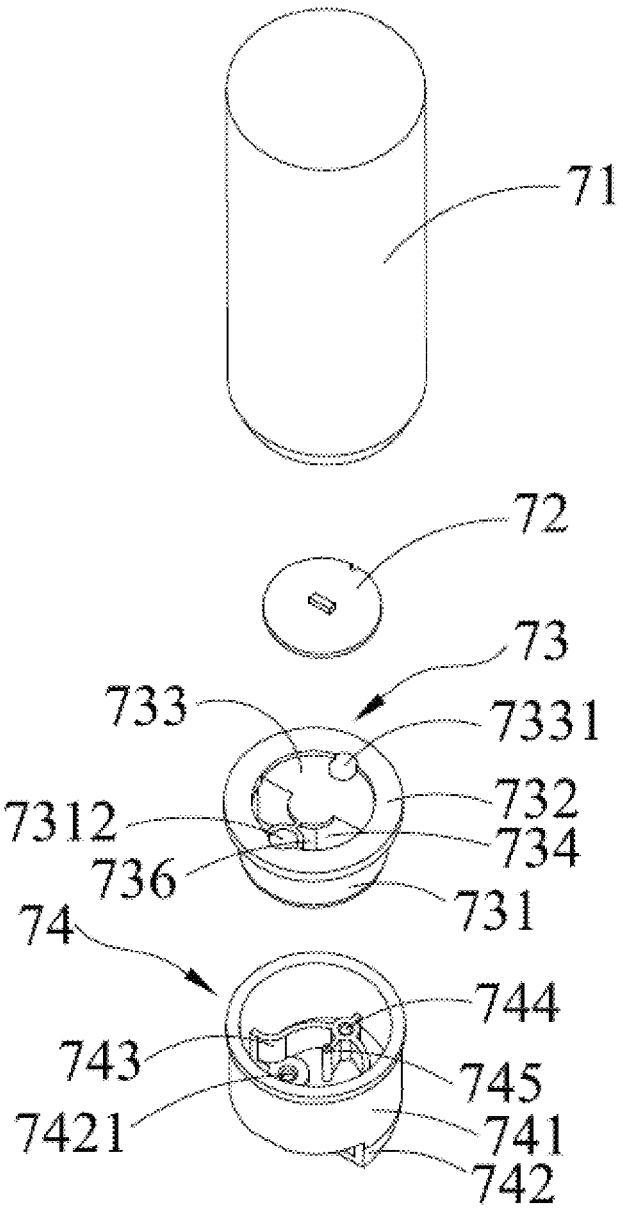
FIGS. 40 and 41 are exploded diagrams of the second lamp holder of the illuminating apparatus shown in FIG. 3 at different angles.
Figure 41:
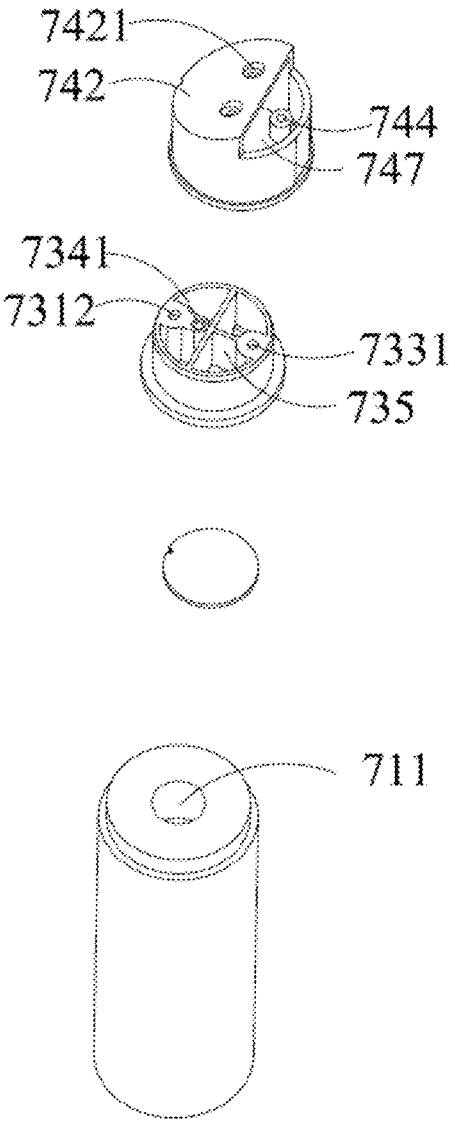

Referring to FIGS. 40 and 41, the second lamp holder 70 includes a transparent housing 71, an LED module 72, a first fixture 73, and a second fixture 74. The transparent housing 71 is bonded to the first fixture 73. The first fixture 73 is fixedly coupled to the second fixture 74. The second fixture 74 is fixedly coupled to the stand 30. The second lamp holder 70 is used as a nightlight of the illuminating apparatus. The LED module 72 includes LED lights and a circuit board. The transparent housing 71 is a hollow cylinder having a cavity 711 for accommodating the LED module 72. The light emitted by the LED lights enters the cavity to achieve an effect of light guiding.

The first fixture 73 is a cylindrical body having a T-shaped cross section and includes a cylinder 731 and a circular ring 732 located at a periphery of an end portion of the cylinder 731. A vertical damper 734 is disposed on a surface of the cylinder 731 where the axis is located. The damper 734 divides the cylinder 731 into two parts. An inner wall of an circular hole of the circular ring 732 couples a stepped plate 733 and an edge of the stepped plate 733 couples the damper 734 to cover a half of the circular hole of the circular ring 732, a gap 736 is thus formed. A through hole 7331 is defined at a joint between the stepped plate 733 and the circular ring 731. An inner wall of the cylinder 731 opposite to the damper 734 is provided with a round wall and the round wall forms a circular hole 7312. Hole walls of the through hole 7331 and the circular hole 7312 are located inside of the cylinder 731, and are coupled to each other through the connecting plate 735 and are separated by the damper 734 to increase an overall strength. The through hole 7331 and the circular hole 7312 pass through two ends of the cylinder 731, and a connecting plate 735 between the through hole 7331 and the circular hole 7312 defines a locating hole 7341 surrounded by a round sidewall. The locating hole 7341 is located at an opposite end of the cylinder 731 with a circular ring 732.

The second fixture 74 is substantially cylindrical, and includes a cylinder wall 741 and a base plate 742 shielding one end of the cylinder wall 741. The base plate 742 partially protrudes from an end portion of the cylinder wall 741 and forms a gap 747 with the cylinder wall 741. And two fixing holes 7421 are defined in a protruding part of the base plate 742. Wherein, the two fixing holes 7421 penetrate the base plate 742. The base plate 742 is provided with a reinforcing rib 743, a screw hole 744, and a positioning column 745 on an inner surface of the cylinder wall 741. The screw hole 744 penetrates the base plate 742, and the hole wall of the screw hole 744 is coupled to the reinforcing rib 743. The positioning column 745 is located on one side of the reinforcing rib 743 and is located between the screw hole 744 and the fixing hole 7421 penetrating the base plate 742.

When the second lamp holder 70 is assembled, the transparent housing 71 is adhered to an end portion of the first fixture 73 having the circular ring 732. The circuit board and the circular ring 732 are fixed to seal the LED module 72 between the transparent housing 71 and the first fixture 73. A wire connecting the LED module 72 passes through the gap 736 of the first fixture 73, the gap 747 of the second fixture 74, and the stand 30 and then enters into the lamp post 20. The positioning column 745 of the second fixture 74 is engaged with the locating hole 7341 of the first fixture 73 to facilitate mutual positioning of the first fixture 73 and the second fixture 74. The through holes 7331 and the circular holes 7312 of the first fixture 73 are screwed to the screw hole 744 of the second fixture 74 by the screw to fix the first fixture 73 to the second fixture 74. The base plate 742 of the second fixture 74 is used to be attached to the stand 30 and screwed through a screw passing through the fixing hole 7421 of the second fixture 74 and the stand 30 so as to fix the second fixture 74 to the stand 30, specifically coupling with any portion of the stand 30, see below the structure description for the stand 30.

Figure 12:
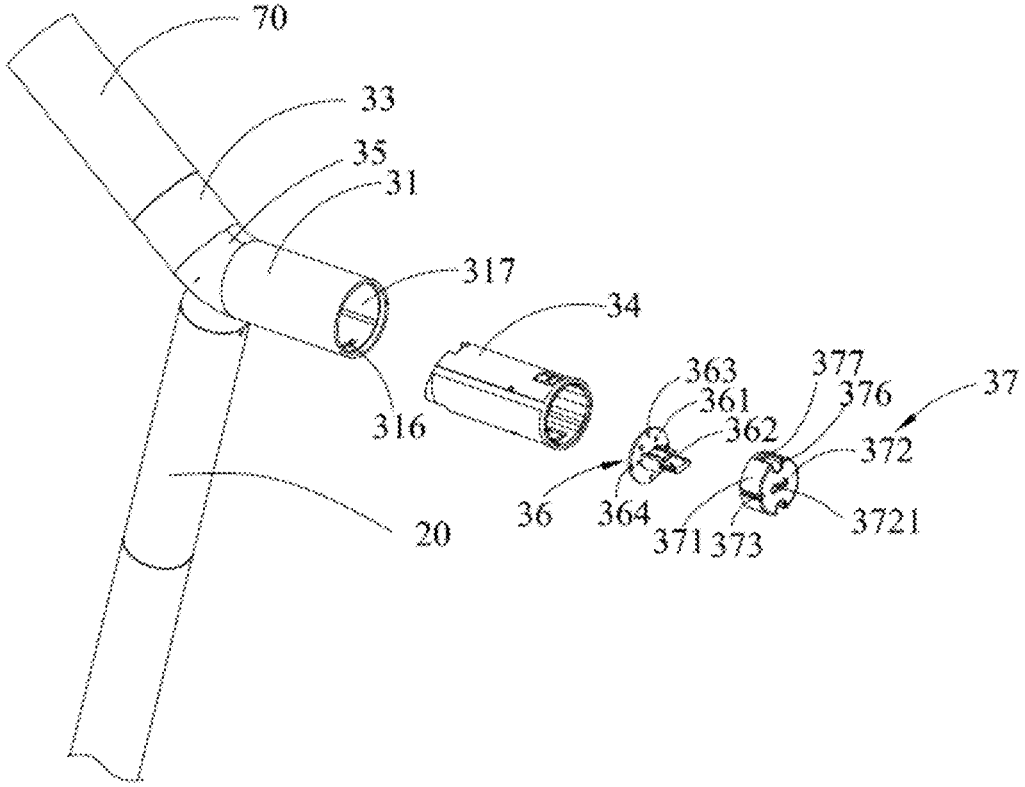
FIG. 12 is an exploded diagram of a first pipe of a stand of the illuminating apparatus shown in FIG. 1.

Referring to FIG. 12, the stand 30 includes a first pipe 31, a second pipe 33, a sleeve 34 installed in the first pipe 31, a connecting segment 35 connecting the first pipe 31 to the second pipe 33, and a joint 36. The first pipe 31 and the second pipe 33 are circular pipes, and the connecting segment 35 is generally V-shaped. The first pipe 31 and the second pipe 33 are coupled to two ends of the connecting segment 35 respectively to form the substantially V-shaped stand 30. The second pipe 33 is used to couple the second lamp holder 70. The first pipe 31 is used to plug in the first lamp holder 50. The first pipe 31 accommodates the joint 36 and also accommodates an inner cover 37. The sleeve 34 is fixed in the first pipe 31, and the joint 36 and the inner cover 37 are fixed in the sleeve 34. The joint 36 is covered by the inner cover 37 and pierces the inner cover 37. The joint 36 is used to be inserted into the interface of the first lamp holder 50 so that the electrical connection between the stand 30 and the first lamp holder 50 is achieved.

Figure 13:
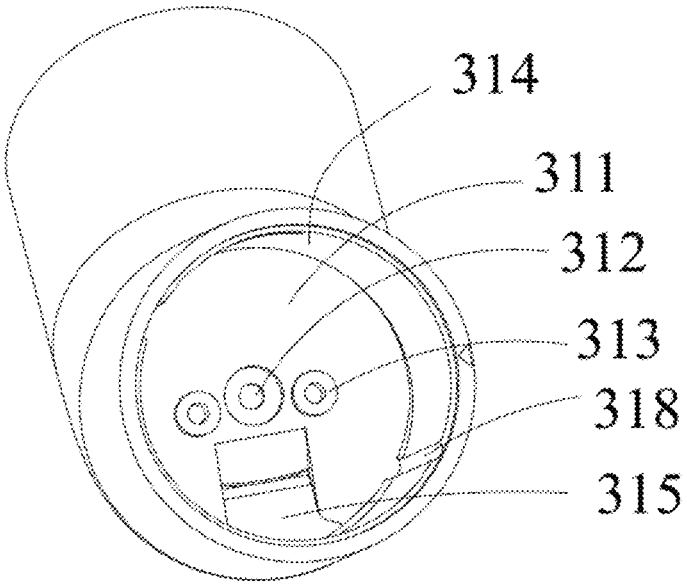
FIG. 13 is a schematic diagram of the first pipe of the stand shown in FIG. 12.

Referring to FIG. 13, the end portion of the first pipe 31 coupled to the connecting segment 35 includes a first end wall 311. The first end wall 311 defines a through hole 312, disposes a stud 313 on both sides of the through hole 312, and defines a through slot 315 interconnected with the connecting segment 35. The stud 313 is located on a surface of the first end wall 311. The engaging groove 316 is defined on a pipe inner peripheral wall 314 of the first pipe 31. The engaging groove 316 is located at the first port 317 of the first pipe 31 opposite to the first end wall 311. The pipe inner peripheral wall of the first pipe 31 also defines an installation guide slot 318 along an axial direction.

Figure 14:
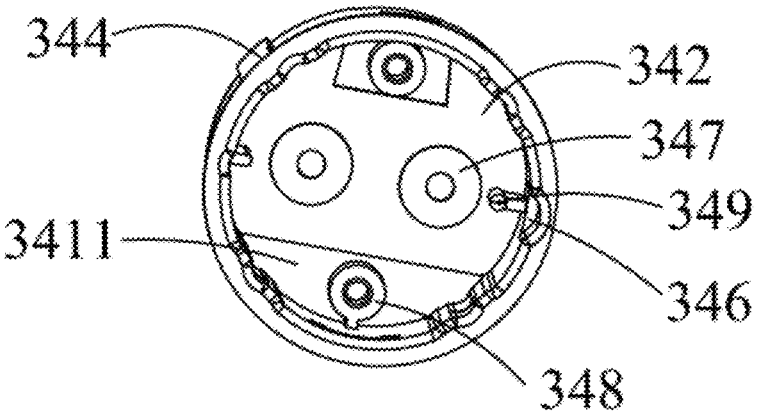
FIGS. 14 and 15 are two different perspective diagrams of a sleeve of the first pipe shown in FIG. 12.
Figure 15:
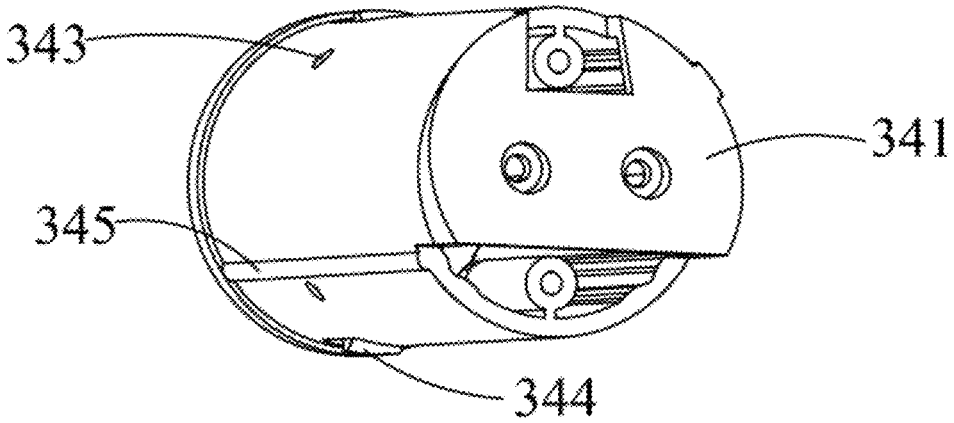

Referring to FIGS. 14 and 15, the sleeve 34 has a cylinder shape and is installed in the first pipe 31. The sleeve 34 includes a second end wall 341 and a second port 342. A plurality of locating holes 343 penetrating the sleeve 34 are defined on the inner peripheral wall of the sleeve 34 and around an axis of the sleeve 34. A peripheral wall of the sleeve 34 includes a clasper 344 opposite to the engaging groove 316 of the first pipe 31, for engaging with the engaging groove 316 to position the sleeve 34 within the first pipe 31. The peripheral wall of the sleeve 34 includes a guiding rid 345 extending along the axial direction. A guide slot 346 is recessed on an inner peripheral wall of the sleeve 34 along the axial direction. The sleeve 34 also includes fixed columns 347, support columns 348, and positioning columns 349. The fixed columns 347, the support columns 348, and the positioning columns 349 are located on a surface of the second end wall 341 within the sleeve 34. The fixed columns 347 and the support columns 348 expose the second end wall 341. The second end wall 341 also defines a notch 3411 interconnected with the sleeve 34. The notch 3411 and the support columns 348 are located on the same side. The number of the fixed columns 347 is two, and the two fixed columns 347 are adjacent to the positioning columns 349.

When the sleeve 34 is installed in the first pipe 31, the second end wall 341 is in contact with the first end wall 311 of the first pipe 31. The screw passes through the fixed column 347 and is further inserted into the stud 313 of the first pipe 31, thereby fixing the sleeve 34 on the first pipe 31. The support column 348 is opposite to the through slot 315. The clasper 344 engages with the engaging groove 316. When the first lamp holder 50 is mounted into the first pipe 31, the balls each received in one circular groove 558 of the connector 55 can be caught in the locating hole 343, thereby fixing the first lamp holder 50 on the first pipe 31. The guiding rid 345 of the sleeve 34 is used to cooperate with the installation guide slot 318 to facilitate to mount the sleeve 34 into the first pipe 31. The rib flange 557 of the connector 55 of the first lamp holder 50 penetrates into the guide slot 346 to facilitate to mount the first lamp holder 50 to the sleeve 34.

The joint 36 is fully received in the sleeve 34. The joint 36 includes a circuit board 361 and an inserted terminal 362 mounted on the circuit board 361. A through hole 363 is defined on the circuit board 361. A locating hole 364 is defined on an outer periphery of the circuit board 361. The inner cover 37 is a cylinder having an open end 371 at one end and a closed end 372 at another end. A through slot 3721 is defined at the closed end 372 for the inserted terminal 362 reaching out. A locating hole 373 is defined on an outer peripheral face of the inner cover 37 along the axial direction, and two ends of the locating hole 373 penetrates the open end 371 and the closed end 372. Two concave portions 376 are also defined on the outer peripheral face of the inner cover 37 along the axial direction. A through hole 377 is defined on a sidewall of the concave portion 376. The side wall is disposed parallel to the closed end 372.

The joint 36 and the inner cover 37 are installed in the sleeve 34. The positioning column 349 of the sleeve 34 passes through the locating hole 364 on the circuit board 361 of the joint 36, thereby positioning the circuit board 361 within the sleeve 34. And the circuit board 361 abuts the support column 348 of the sleeve 34. The locating hole 373 of the inner cover 37 also sleeves on the positioning column 349 of the sleeve 34 and clamps the circuit board 361 on the second end wall 341 of the sleeve 34 so as to position the inner cover 37 and the sleeve 34. The inserted terminal 362 passes through the open end 371 and is exposed the through slot 3721. The screw passes through the through hole 377 of the inner cover 37 and the through hole 363 of the circuit board 361 to lock into the support column 348 of the sleeve 34, thereby fixing the joint 36 and the inner cover 37 in the sleeve 34.

Referring to FIGS. 2, 11 and 12, when the first lamp holder 50 is inserted with the stand 30, the balls of the connector 55 are inserted into the locating hole 343 of the sleeve 34, and the rib flange 557 of the connector 55 penetrates into the guide slot 346 of the sleeve 34. The terminal 362 of the joint 36 of the first pipe 31 of the stand 30 is inserted into the interface 552 of the first lamp holder 50. That is, a physical connection between the first lamp holder 50 and the stand 30 is realized, and an electrical connection between the stand 30 and the first lamp holder 50 is realized. When the first lamp holder 50 needs to be used alone, it is only necessary to pull the first lamp holder 50, and the disassembly is more convenient. The battery 532 in the first lamp holder 50 provides power through the circuit board and realizes illumination of the first lamp holder 50. Therefore, the illuminating apparatus of the present disclosure can be adapted to a variety of different occasions. For example, when it is necessary to read a book, the first lamp holder 50 and the stand 30 can be assembled to form the illuminating apparatus. When it is necessary to go out, the first lamp holder 50 can be pulled out and carried for illumination.

Figure 16:
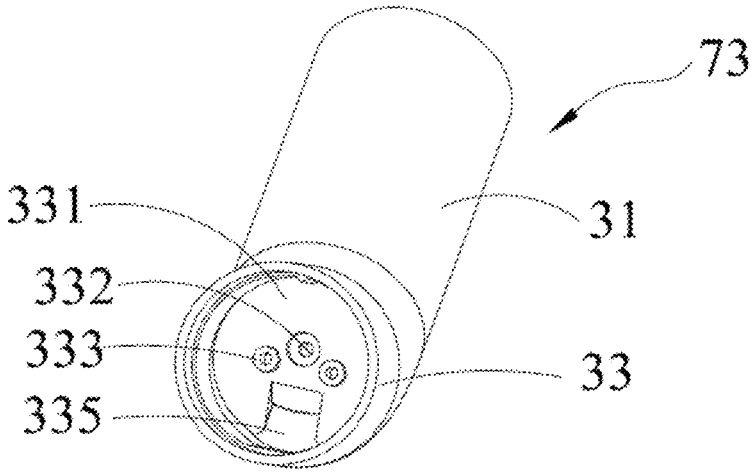
FIG. 16 is a schematic diagram of a second pipe of the stand shown in FIG. 12.

Referring to FIGS. 16 and 3, an end portion of the second pipe 33 coupled to the connecting segment 35 includes a third end wall 331. The third end wall 331 defines a through hole 332, disposes a stud 333 located at both sides of the through hole 332 and a through slot 335 interconnected with the connecting segment 35. The stud 333 is located inside the second pipe 33. The through hole 332 and the through slot 335 pass through the connecting segment 35. The base plate 742 of the second fixture 74 is attached to the third end wall 331 of the second pipe 33. The screw passes through the fixing hole 7421 of the second fixture 74 and is locked in the stud 333 of the second pipe 33, thereby fixing the second fixture 74 to the second pipe 33 of the stand 30. The base plate 742 of the second fixture 74 is overlapped with the third end wall 331, and the through slot 335 opposes and communicates with the gap 747. The wire connecting the LED module 72 passes through the gap 736 of the first fixture 73, the gap 747 of the second fixture 74, and the through slot 335 of the second pipe 33 on the stand 30 to enter the lamp post 20.

Figure 21:
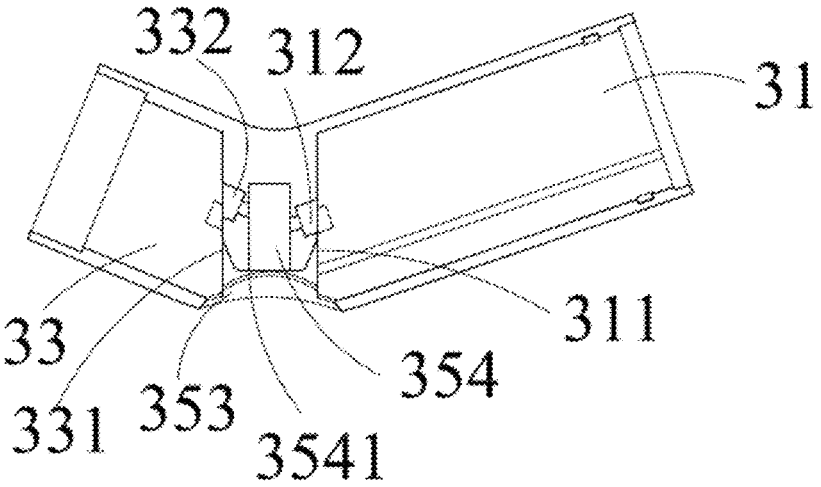
FIG. 21 is a schematic and plan diagram of an interior of the stand of the illuminating apparatus shown in FIG. 1.
Figure 22:
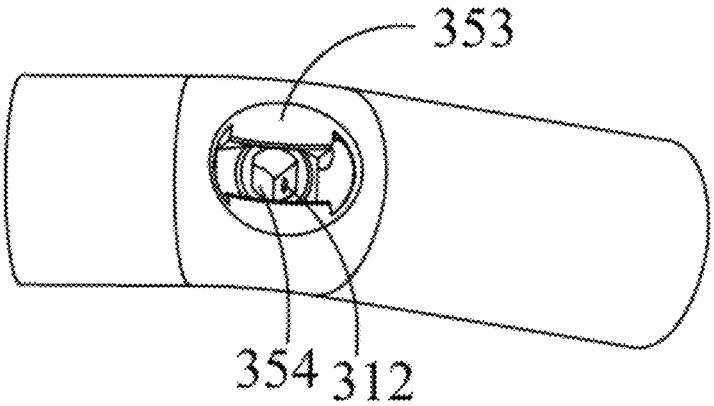
FIG. 22 is a diagram of a partial structure of a connecting segment of the stand shown in FIG. 20.

Referring to FIGS. 21 and 22, the connecting segment 35 includes two connecting ends and a protruding portion located between the two connecting ends. The two connecting ends are coupled to the first pipe 31 and the second pipe 33 respectively. The protruding portion is cut to form a spherical through slot 353. A slot 354 is located at a bottom of the spherical through slot 353. The slot 354 has two opposing slot walls 3541. One of the two slot walls 3541 is opposite to the first end wall 311 of the first pipe 31, and the other slot wall 3541 is opposite to the third end wall 331 of the second pipe 33. The through hole 312 on the first end wall 311 runs through the slot wall 3541. A through hole 332 on the third end wall 331 runs through another slot wall 3541. The through hole 312, the through hole 332, the slot 354, and the spherical through slot 353 are thus interconnected. Through slots 315 and 335 are located on opposite sides of the spherical through slot 353 of the connecting segment 35, respectively, for passing the wires of the first lamp holder 50 and the second lamp holder 70.

Figure 23:
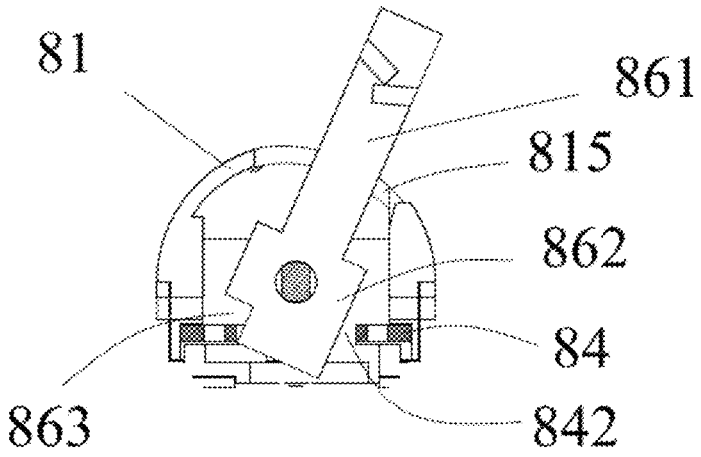
FIG. 23 is a schematic and internal plan diagram of the rotating assembly of the illuminating apparatus shown in FIG. 1.
Figure 25:
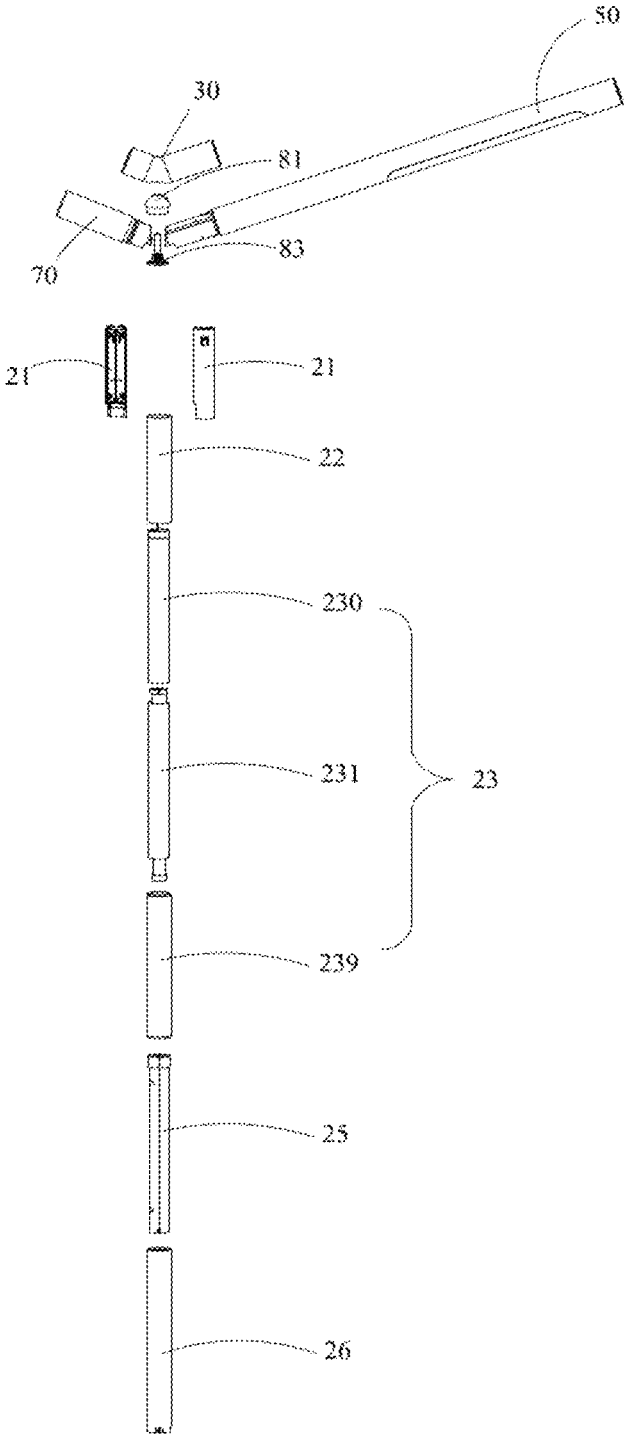
FIG. 25 is an exploded diagram of a lamp post, a rotating assembly, a first lamp holder, a second lamp holder and a stand shown in FIG. 1.

Referring to FIGS. 23 and 25, the illuminating apparatus further includes a lamp holder rotating assembly. The lamp holder rotating assembly is mounted on the connecting segment 35 of the stand 30 and drives the first lamp holder 50 and the second lamp holder 70 to rotate in an up-down direction perpendicular to a horizontal plane. The lamp holder rotating assembly includes a rotating head 81 and a foundation support 83. The rotating head 81 rotates on the foundation support 83. The rotating head 81 is fixed on the lamp post 20.

Figure 17:
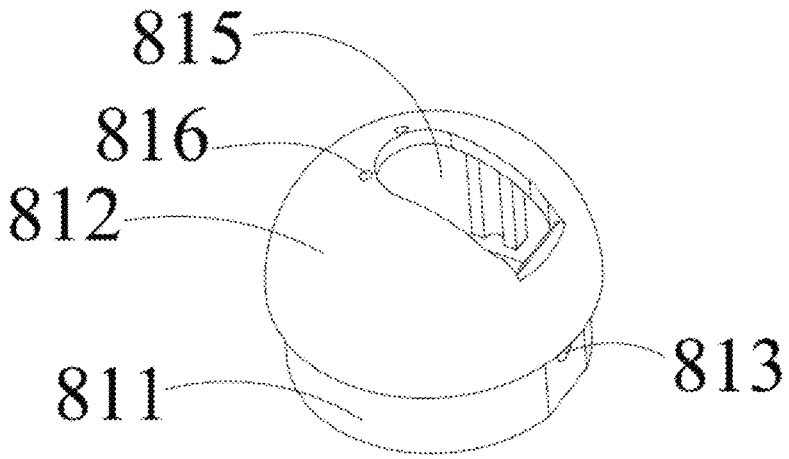
FIGS. 17 and 18 are diagrams of a rotating head of a rotating assembly of the illuminating apparatus shown in FIG. 1 at different angles.
Figure 18:
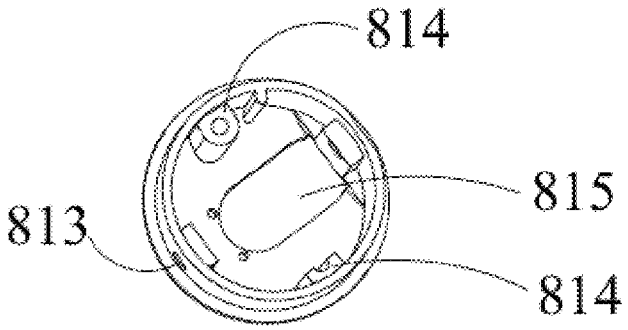

Referring to FIGS. 17 and 18, the rotating head 81 is a hollow body, which includes a cylinder neck 811 and a hemispherical head portion 812 located at one end of the neck 811. The other end of the neck 811 is an open end. A screw hole 813 penetrating an interior of the neck 811 is defined on a peripheral wall of the neck 811 for a screw passing and locking on the lamp post 20. The head portion 812 can be accommodated in the spherical through slot 353 of the stand 30 and can rotate therein. The head portion 812 includes two fixed columns 814 on an inner surface of the neck 811. The fixed column 814 is used for the screw passing through to further fix the rotating head 81 to the foundation support 83. A bar-shaped groove 815 is located on one side of a center of the head portion 812. The groove 815 is offset from a center axis of the head portion 812. The groove 815 penetrates the interior of the neck 811. One side of the groove 815 defines a threading hole 816. The threading hole 816 is close to the groove 815 and is smaller in diameter than the groove 815.

Figure 19:
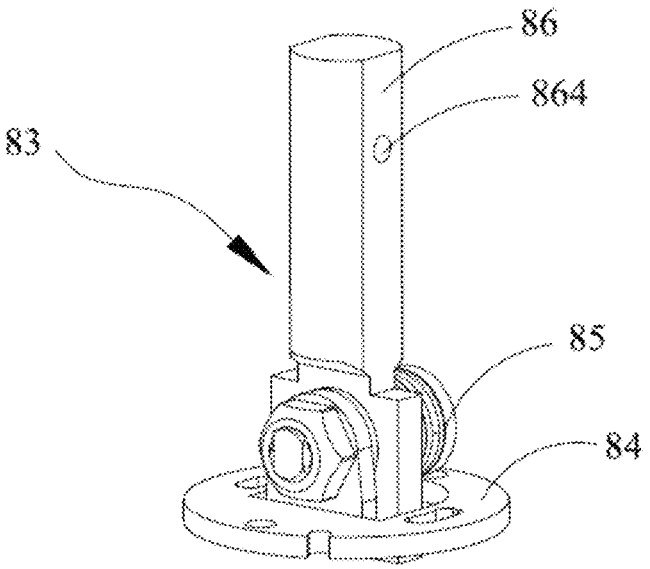
FIG. 19 is a schematic diagram of a foundation support of a rotating assembly of the illuminating apparatus shown in FIG. 1.
Figure 20:
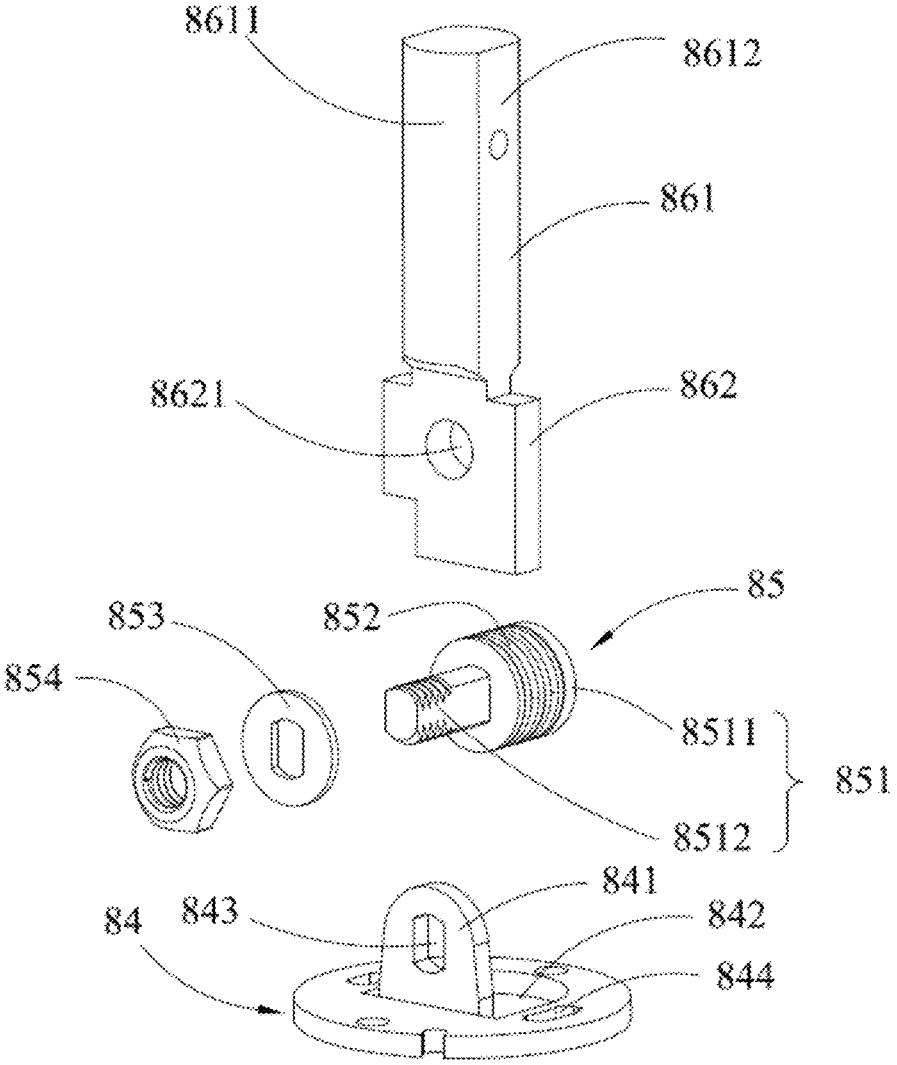
FIG. 20 is an exploded diagram of the foundation support shown in FIG. 19.

Referring to FIGS. 19 and 20, the foundation support 83 includes a base plate 84, an inserted rod 86, and a fixing member 85. The base plate 84 has a circular plate body. The base plate 84 includes a locating slot 842 passing through the base plate 84, a support chip 841 protruding from the base plate 84 and located at one end of the locating slot 842, and defines fixing holes 844. The support chip 841 defines a through hole 843 having a rectangular cross section. The number of the fixing holes 844 are two and the two fixing holes 844 are located at the periphery of the base plate 84.

The inserted rod 86 includes a head end 861 and a tail end 862 coupled to the head end 861. The head end 861 is a long cylinder including two opposite curved outer sides 8611 and two opposing flat faced end faces 8612. Each end face 8616 of the head end 861 defines a screw hole 864. The orientations of the two screw hole 864 are different. A circular hole 8621 is formed on the tail end 862. The axial direction of the circular hole 8621 is perpendicular to the axial direction of the screw hole 864. The tail end 862 is generally a quadrilateral plate with a notch 863 at one corner (see FIG. 23). The fixing member 85 includes a T-shaped rod body 851, a spring 852, a spacer 853, and a nut 854. The rod body 851 includes a head end and a connecting rod 8511 connected to the head end. One end of the connecting rod 8511 is a threaded connecting end 8512. The spring 852 is sleeved on the connecting rod 8511 and compressed between the head end of the rod body 851 and the inserted rod 86. The connecting end 8512 is rectangular in cross-section. The spacer 853 is sleeved on the connecting end 8512. The fixing member 85 also includes a nut 854 sleeved on the connecting rod 8511. The support chip 841 is located between the nut 854 and the tail end 862 of the inserted rod 86.

Further, an outer peripheral surface of the connecting rod 8511 includes a plane. The support chip 841 defines a through hole 843 through which the connecting rod 8511 is inserted. An inner peripheral surface of the through hole 843 forms a plane. The connecting rod 8511 is passed through the through hole 843 of the support chip 841 while the two planes abut to prevent the connecting rod 8511 from rotating relative to the support chip 841.

Figure 24:
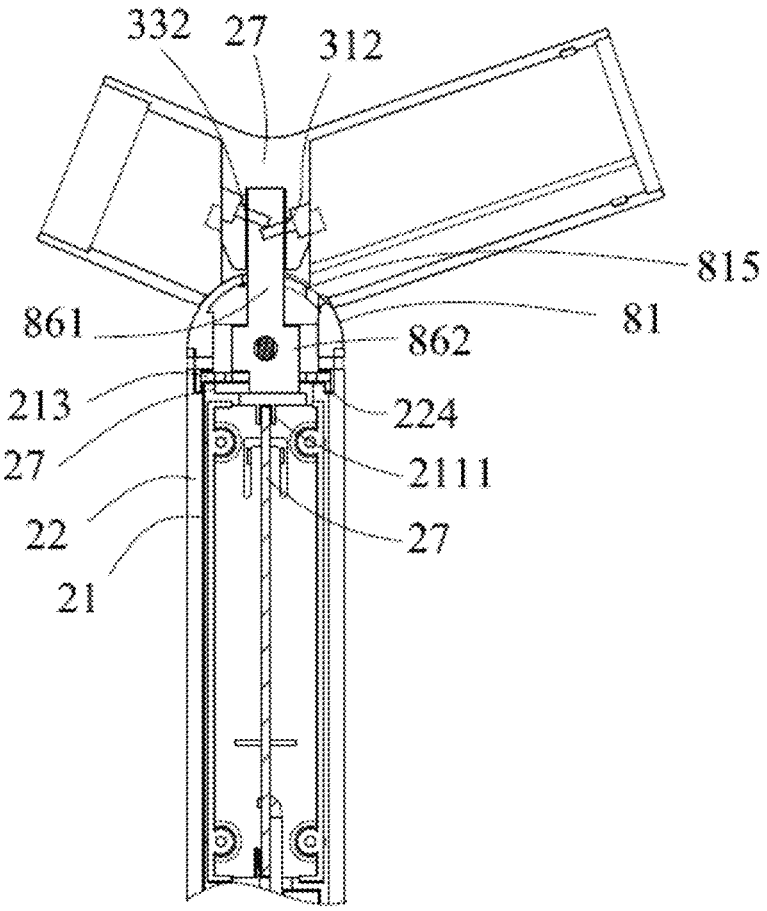
FIG. 24 is a diagram of a connection between a rotating assembly, a stand, and an engaging segment of the lamp post shown in FIG. 1.

Referring to FIGS. 23 and 24, the inserted rod 86 is rotatably mounted on the foundation support 83 through the fixing member 85. The tail end 862 of the inserted rod 86 is inserted into the locating slot 842. The connecting end 8512 of the fixing member 85 passes through the tail end 862 of the inserted rod 86 and the through hole 843 of the support chip 841, and is thus locked by the nut 854. The support chip 841 is located between the spacer 853 and the nut 854. The outer peripheral surface of the connecting rod 8511 includes a flat surface. The support chip 841 forms a through hole 843 through which the connecting rod 8511 is inserted. The inner peripheral surface of the through hole 843 forms a flat surface. When the connecting rod 8511 is inserted through the through hole of the support chip 841, the two planes abut and limit the rotation of the connecting rod 8511 relative to the support chip 841. The cross-section of the connecting rod 8511 is rectangular, and the cross-section of the through hole 843 is rectangular. The fixing member 85 cannot rotate after the connecting end 8512 passes through the hole 843. By rotating the nut 854 at the end of the fixing member 85, the spring 852 can be pressed against the head end 861 without causing the fixing member 85 to rotate with the nut 854. By adjusting the nut 854, the pressure of the spring 852 can be changed to adjust a rotational damping force of the inserted rod 86.

Understandably, the present disclosure also includes a lamp holder rotating assembly with another structure: the foundation support includes a base plate, the locating slot is defined on the base plate, and the base plate is located at both ends of the locating slot. The support chip includes a rotating shaft and a torsion spring mounted on the rotating shaft. The tail end of the inserted rod is sleeved on the rotating shaft. Two ends of the rotating shaft are rotated and mounted on the two support chips. The two ends of the torsion spring resist one of the support chips and the tail end of the inserted rod.

When the lamp holder rotating assembly is mounted on the stand 30, the head end 861 of the inserted rod 86 is inserted into the slot 354 of the stand 30 through the open end of the rotating head 81 and the groove 815. The two screw holes 864 of the head end 861 of the inserted rod 86 are respectively coupled to the connecting segment 33 of the stand 30. The through hole 312 and the through hole 332 are aligned, and the screw is inserted into the screw hole 864 through the through hole 312 and the through hole 332 so as to fix the inserted rod 86 to the stand 30. A locking member passes through the fixing hole 844 of the base plate 84 from the bottom and locks into the two fixed columns 814 of the rotating head 81, so that the foundation support 83 and the rotating head 81 are fixed. The head end 861 rotates in the first direction within the groove 845 and drives the tail end 862 to rotate in the opposite second direction within the locating slot 842. When the tail end 862 rotates within the locating slot 842, it abuts the opposite side edges of the locating slot 842 respectively and limits the rotation angle of the inserted rod 86. Since the tail end 862 of the inserted rod 86 defines the notch 863, after the inserted rod 86 is mounted on the base 83, the tail end 862 can rotate within a certain range within the locating slot 842 until the tail end 862 abuts the inner edge of the locating slot 842. In detail, when the inserted rod 86 is rotated downwards, its tail end 862 will eventually obliquely abut one side of the inner edge of the locating slot 842, and when the inserted rod 86 is rotated upwards, its tail end 862 will eventually abut vertically against one inner edge of the opposing slot 842. During the rotation, the head end 861 of the inserted rod 86 rotates within the groove 815 of the rotating head 81, thereby driving the first lamp holder 50 and the second lamp holder 70 to rotate in the up-down direction, so that the first lamp holder 50 and the second lamp holder 70 can rotate according to the need.

Figure 27:
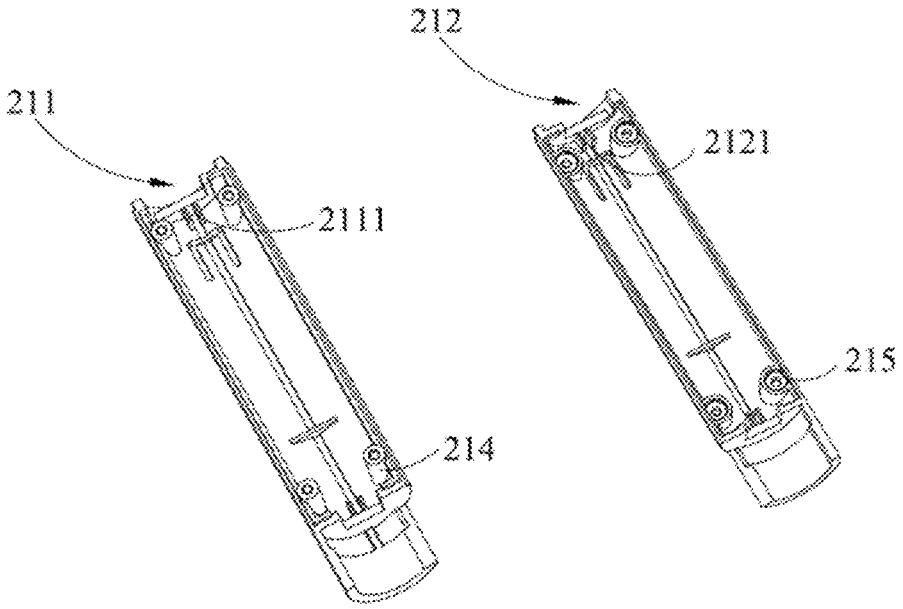
FIG. 27 is an exploded diagram of a pipe of an engaging segment of the lamp post of the illuminating apparatus shown in FIG. 25.
Figure 28:
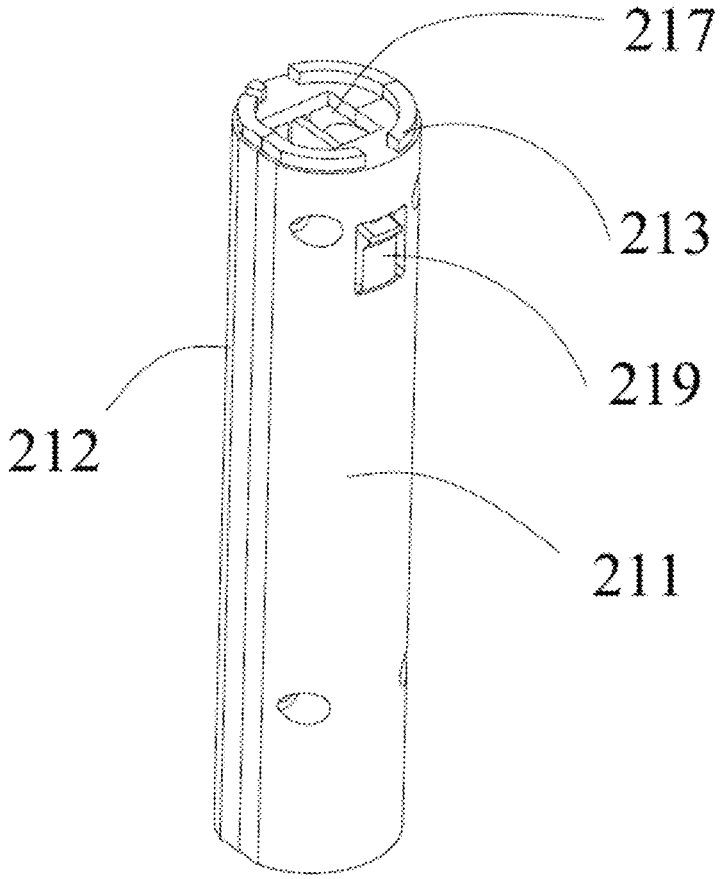
FIG. 28 is an assembly diagram of the pipe shown in FIG. 27.
Figure 29:
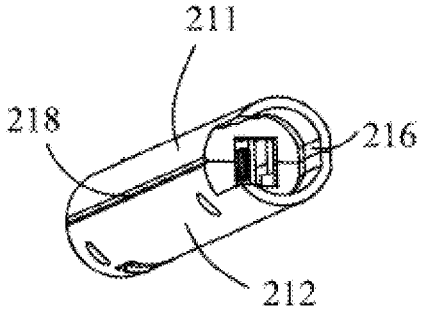
FIG. 29 is a diagram of the pipe shown in FIG. 28 seen from another angle.
Figure 30:
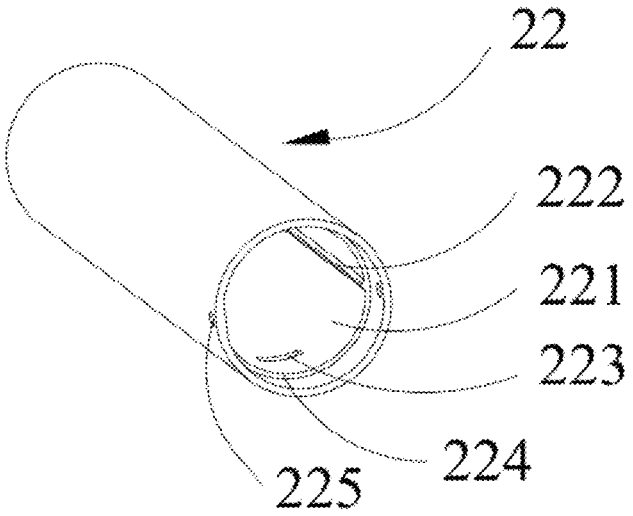
FIG. 30 is a diagram of a metal pipe of an engaging segment of the lamp post shown in FIG. 25.
Figure 31:
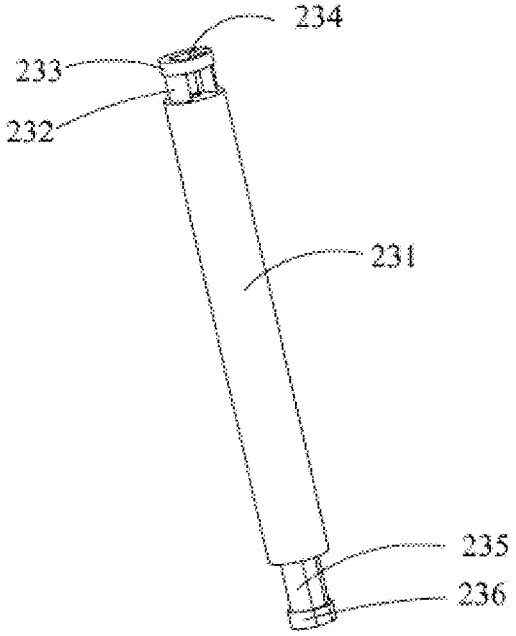
FIG. 31 is a diagram of a transparent pipe of a lamp post shown in FIG. 25.
Figure 32:
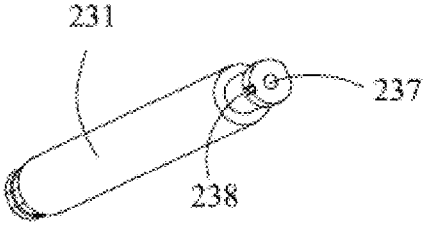
FIG. 32 is a diagram of the transparent pipe of the lamp post shown in FIG. 31 seen from another angle.

Please referring to FIGS. 24, 25 and 27, the lamp post 20 of the present disclosure includes an engagement segment. The engagement segment includes a pipe 21 and a peripheral pipe. The lamp post 20 is a long bar as a whole, and further includes a circuit board 27. The lamp post also includes a touch segment 23 and a support segment coupled in sequence. The second control module is mounted on the circuit board 27. The engagement segment forms an engagement structure for connection with the lamp holder rotating assembly 80. As shown in FIGS. 27 and 30, the engagement segment includes a pipe 21 and a metal pipe 22 (that is, a peripheral pipe, which is preferably a metal pipe, hereinafter collectively referred to as a metal pipe). The metal pipe 22 is integrally molded. The buckle 21 is in a semi-tubular shape. The first pipe body 211 and the second pipe body 212 are semi-circular in section and are engaged into the peripheral pipe. The inner wall of the first pipe body 211 includes a limit convex column 214 and a limit plate 2111. The limited convex column 214 and the limit plate 2111 are located at opposite ends of an arc-shaped inner wall of the first pipe body 211. A limit convex column 215 and a limit plate 2121 are disposed on the inner wall of the second pipe body 212. The limit convex column 215 and the limit plate 2121 are located at opposite ends of the inner wall of the second pipe body 212. Referring to FIGS. 28 and 29, end surfaces of the first pipe body 211 and the second pipe body 212 each includes a curved flange 213. Other end surface edges of the first pipe body 211 and the second pipe body 212 each extend a curved ring edge 216.

Referring to FIGS. 28 and 29, the first pipe body 211 is engaged with the second pipe body 212. A screw passes through the limit convex column 214 and the limit convex column 215 to fixedly couple the first pipe body 211 and the second pipe body 212 so as to form the pipe 21 having a cylindrical shape. Two ends of the pipe 21 are openings 217. The limit plate 2111 and the limit plate 2121 engage with each other for clamping the circuit board 27 of the lamp post 20. The flange 213 of the first pipe body 211 and the flange 213 of the second pipe body 212 engage with each other to form a circular ring edge surrounding the opening 217. After the first pipe body 211 and the second pipe body 212 are engaged with each other, the connected sides form a guide groove 218. The guide groove 218 penetrates the flange and the ring edge in the axial direction of the pipe 21. The first pipe body 211 and the second pipe body 212 each includes a clasper 219 that is close to one end position where the flange is located.

Referring to FIG. 30, the metal pipe 22 is a circular pipe having two opposite openings, and the inner peripheral wall 221 includes a positioning rib flange 222 and defines a groove 223. The positioning rib flange 222 extends in the axial direction of the metal pipe 22. The groove 223 is located at a position of the end portion of the metal pipe 22. The inner peripheral wall 221 of the metal pipe 22 includes an abutting boss 224 at an opening of the end portion. A hole 225 is defined between the metal pipe 22 and the end portion of the abutting boss 224.

When the lamp holder rotating assembly is mounted on the engagement segment, the pipe 21 is firstly docked and is pre-fixed by screws. The rotating head 81 and the foundation support 83 are also pre-fixed by screws, and then the metal pipe 22 is sleeved on an outside of the fixed pipe 21. The positioning rib flange 222 slides in the guide groove 218 so as to align the metal pipe 22 with the pipe 21. The clasper 219 of the pipe 21 and the groove 223 of the metal pipe 22 are engaged with each other so that the pipe 21 is mounted to the metal pipe 22. The neck 811 of the rotating head 81 of the lamp holder rotating assembly is inserted into one end of the metal pipe 22 to abut against the abutting boss 224. The hole 225 faces the screw hole 813 and the hole 225 couples to the screw hole 813 through the screw, so that the rotating head 81 is fixed to the metal pipe 22. The base plate 84 is located above the flange 213 of the pipe 21. After the tail end 862 of the inserted rod 86 passes through the locating slot 842 of the base plate 84 of the foundation support 83, and also penetrates the opening 217 surrounded by the flange 213 of the end portion of the pipe 21. Therefore, the lamp holder rotating assembly is fixed to the pipe 21 through the metal pipe 22. This fixing type is conducive to an overall disassembly process.

Referring to FIGS. 25, 31, 32, and 38, the touch segment 23 includes a transparent pipe 231, a flexible touch pad 230, and a protective film 239. The flexible touch pad 230 is attached on an outer peripheral face of transparent pipe 231, the second lamp holder 70 and the flexible touch pad 30 are electrically coupled to the second control module (ie, the aforementioned control module). The second control module controls the first lamp holder 50 and the second lamp holder 70 to work cooperatively based on a touch operation acted on the flexible touch pad 230. The second control module is located above the flexible touch panel 230, specifically, on the circuit board 27. The control module is the second control module. The protective film 239 is attached to an outer side of the flexible touch panel 230. The flexible touch panel 230 is electrically coupled to the circuit board 27 of the pipe 21 through the FPC to realize a touch function of the touch segment 23. In detail, the touch function includes the switch of the illuminating apparatus, the first lamp holder and/or the second lamp holder of the illuminating apparatus, and color adjustment.

The transparent pipe 231 is coupled to one end of the pipe 21 with a ring edge. One end of the transparent pipe 231 includes a round table 232 and a flange collar 233 formed on the round table 232. The flange collar 233 protrudes outwardly relative to the round table 232. The other end of the transparent pipe 231 includes a round table 232 and a convex ring 236. The convex ring 236 is protruding outwardly relative to the round table 232 and is further received in an arc-shaped groove of the support segment. In detail, a first transparent table 232 and a flange collar 233 are protruded at one end of the transparent pipe 231. The flange collar 233 surrounds a perimeter of the end portion of the first round table 232. The end face of the first round table 232 defines a hole 234. The other end of the transparent pipe 231 includes a second round table 235 and a convex ring 236. The convex ring 236 is disposed around a periphery of an end portion of the second round table 235. The end face of the convex ring 236 defines a through hole 237 that penetrates the entire transparent pipe 231. The through hole 237 interconnects with the hole 234. The outer peripheral face of the second round table 235 defines a notch 238 along the axial direction. The outer diameter of the flange collar 233 of the first round table 232 is greater than the outer diameter of the convex ring 236.

Figure 38:
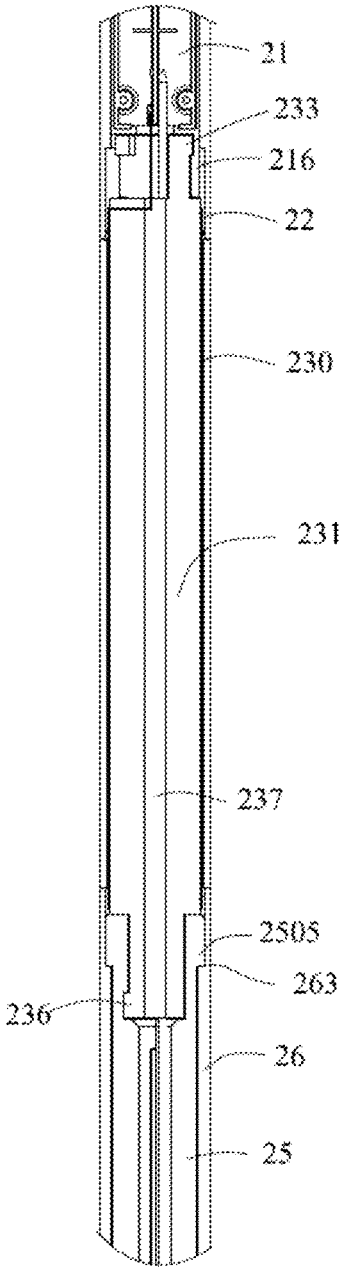
FIG. 38 is a schematic and plan diagram of an engaging segment, a touch segment, and a support segment of the lamp post of the illuminating apparatus shown in FIG. 25.

Referring to FIGS. 25 and 38, the transparent pipe 231 is coupled to one end of the pipe-shaped pipe 21 having a ring edge. In detail, when the first pipe body 211 and the second pipe body 212 of the pipe 21 are engaged, an engaging groove is formed on an inner side of an end portion of the ring edge 216. The flange collar 233 is inserted into the engaging groove of the first pipe body 211 and the second pipe body 212, and further abuts the ring edge 216, so that the transparent pipe 231 and the pipe 21 are fixed. Then, the first pipe body 211 and the second pipe body 212 are fixed, and the metal pipe 22 are sleeved. The peripheral pipe surrounds an upper portion of the transparent pipe 231 and shields the first round table 232 and the flange collar 233. In other words, an end portion of the metal pipe 22 is sleeved on the first round table 232 and the flange collar 233 of the transparent pipe 231, so as to avoid structures of the first round table 232 and the flange collar 233 of the transparent pipe 231 from being seen from outside.

The support segment and the pipe 21 are located at opposite ends of the touch segment 23, respectively. The support segment includes a first semi-cylinder 251, a second semi-cylinder 252, and a peripheral cylinder for receiving the first semi-cylinder 251 and the second semi-cylinder 252. In detail, referring to FIGS. 33 and 34, the support segment includes a pipe 25 and a metal cylinder 26 (ie, the outer cylinder, which is preferably a metal cylinder in this embodiment) sleeved on an outside of the pipe 25. The metal cylinder is molded in one piece. As shown in FIG. 34, the pipe 25 includes a first semi-cylinder 251 and a second semi-cylinder 252. One end of the metal cylinder 26 extends upward beyond a top of the first semi-cylinder 251 and the second semi-cylinder 252. The first semi-cylinder 251 and the second semi-cylinder 252 are abutted to form the pipe 25. The arc-shaped inner surface of the first semi-cylinder 251 defines a first channel 250 and disposes a convex column 253. The first channel 250 is axially disposed along the first semi-cylinder 251, and is disposed on both sides of the first channel 250 with an rib 2501. The convex column 253 is convexly disposed at one end of the first channel 250. The first semi-cylinder 251 includes a semicircular first flange 254 at one end and a semicircular first ring edge 255 at the other end. The center axes of first flange 254 and first ring edge 255 coincide with the axes of first semi-cylinder 251. There is an arc-shaped engaging groove 256 located between the first flange 254 and the convex column 253.

The arc-shaped inner surface of the second semi-cylinder 252 defines a second channel 257 and a recessed hole 258. The second channel 257 is axially defined along the second semi-cylinder 252. A strip slot 2571 is defined on both sides of the second channel 257. The recessed hole 258 is defined at one end of the second channel 257. One end of the second semi-cylinder 252 includes a semicircular second flange 2251, and the other end includes a semicircular second ring edge 2522. The center axes of the second flange 2521 and the second ring edge 2522 coincide with the axes of the second semi-cylinder 252. An engaging groove 259 is defined between second flange 2521 and the recessed hole 258.

The first semi-cylinder 251 and the second semi-cylinder 252 are faced with each other and are screwed through the recessed hole 258 and locked into the convex column 253, so as to realize the assembly and fixation of the two buckle cylinders. Wherein, the rib 2501 of the first semi-cylinder 25 is embedded in the strip slot 2571 of the second semi-cylinder 252 to help to position the second semi-cylinder 252 and the first semi-cylinder 251. The first channel 250 and the second channel 257 are aligned to form a pipe. The engaging groove 256 of the first semi-cylinder 251 and the engaging groove 259 of the second semi-cylinder 252 are used to engage with convex ring of the transparent pipe 23. The first flange 254 of the first semi-cylinder 251 and the second flange 2521 of the second semi-cylinder 252 are aligned to form a flange 2505 for engagement with the metal cylinder 26. The first ring edge 255 of the first semi-cylinder 251 and the second ring edge 2522 of the second semi-cylinder 252 align to form a closed ring edge and form a through hole at the ring edge side.

Figure 33:
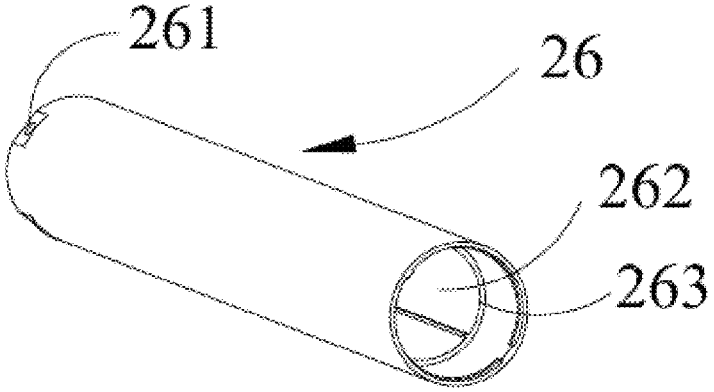
FIG. 33 is a diagram of a metal cylinder of a support segment of the lamp post shown in FIG. 25.
Figure 34:
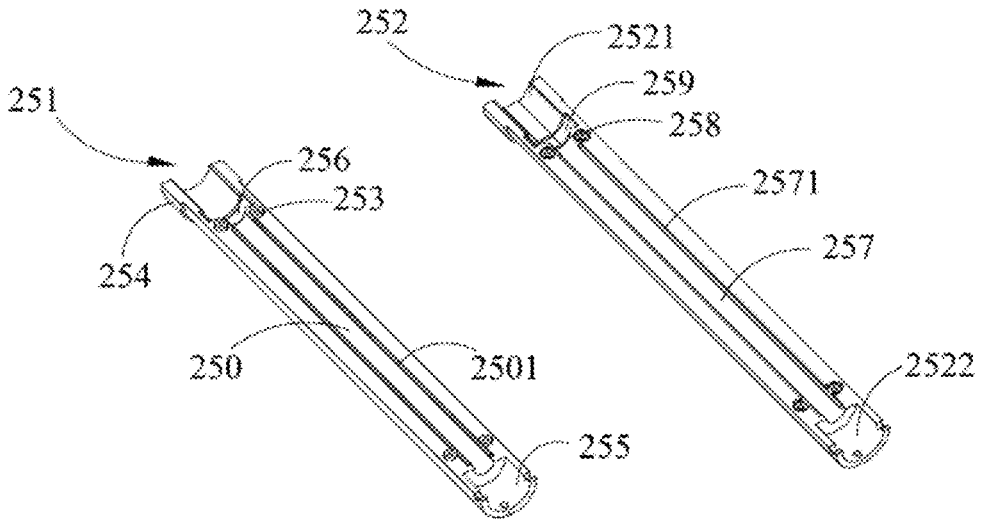
FIG. 34 is an exploded schematic diagram of a semi-cylinder of the support segment of the lamp post shown in FIG. 25.

Referring to FIG. 33, the metal cylinder 26 is a hollow cylinder. A through hole 261 is defined at one end of the cylinder wall of the metal cylinder 26. One end of the inner peripheral wall 262 of the metal cylinder 26 includes a stepper 263 around the inner peripheral wall. The stepper 263 and the through hole 261 are located at opposite ends of the metal cylinder 26. The through hole 261 is used for coupling with the base 10.

The pipe 25 is coupled to the transparent pipe 231. The first semi-cylinder 251 and the second semi-cylinder 252 of the pipe 25 are sleeved on an outside of the transparent pipe 231, so that one end of the transparent pipe 231 having a convex ring 236 is inserted into the pipe 25, and engaged with the engaging grooves 256, 259. Then, the first semi-cylinder 251 and the second semi-cylinder 252 are screwed through the recessed hole 258 and locked into the convex column 253 and locked to fix the first semi-cylinder 251 and the second semi-cylinder 252. A metal cylinder 26 is sleeved on an outside of the pipe 25. The stepper 263 is held by the flange of the pipe 25. In other words, the convex ring of the transparent pipe 231 engages with the engaging groove of the pipe 25, thereby completing a fixation between the transparent pipe 231 and the pipe 25. The flange of the pipe 25 is engaged with the stepper 263 of the metal cylinder 26 to complete a fixation of the three. The overall disassembly can be made more convenient by this fixing way. One end of the metal cylinder 26 extends upward beyond the first semi-cylinder 251 and the flange 2505 of the second semi-cylinder 252.

Figure 26:
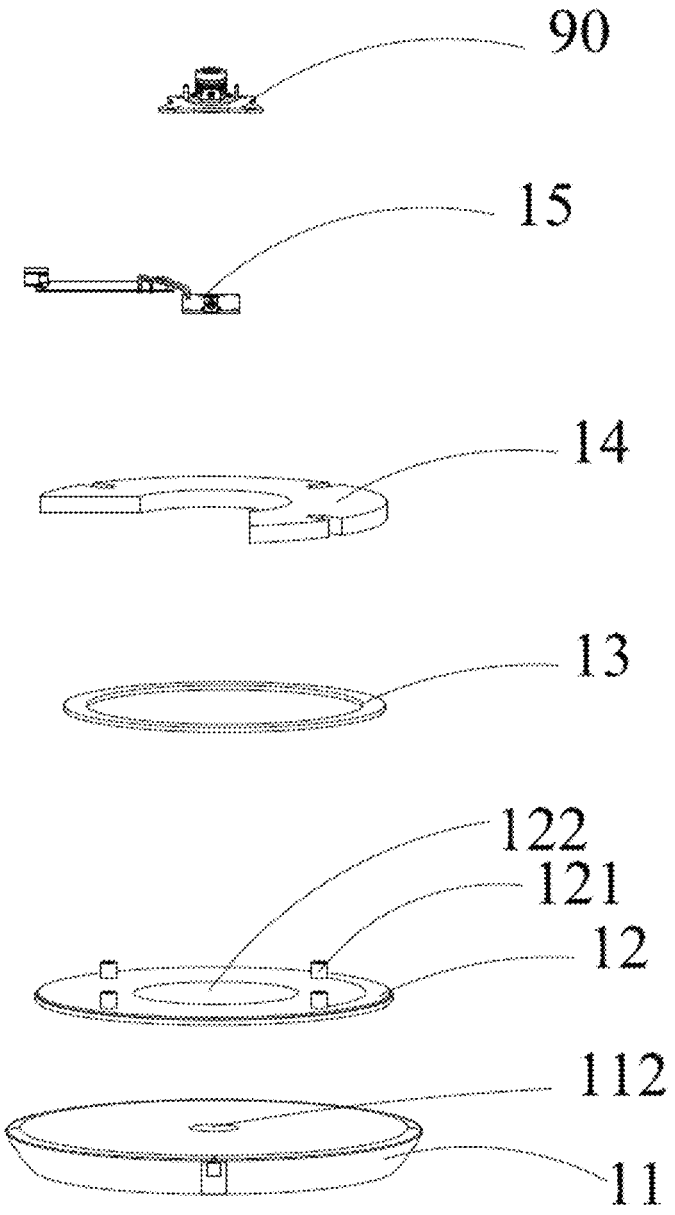
FIG. 26 is an exploded diagram of a base and a lamp post rotating assembly of the illuminating apparatus shown in FIG. 1.
Figure 35:
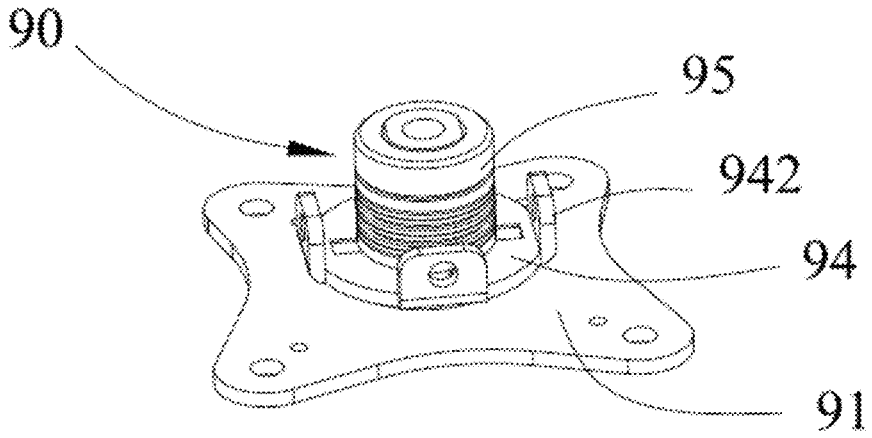
FIG. 35 is a schematic diagram of a lamp post rotation assembly of the illuminating apparatus shown in FIG. 26.
Figure 37:
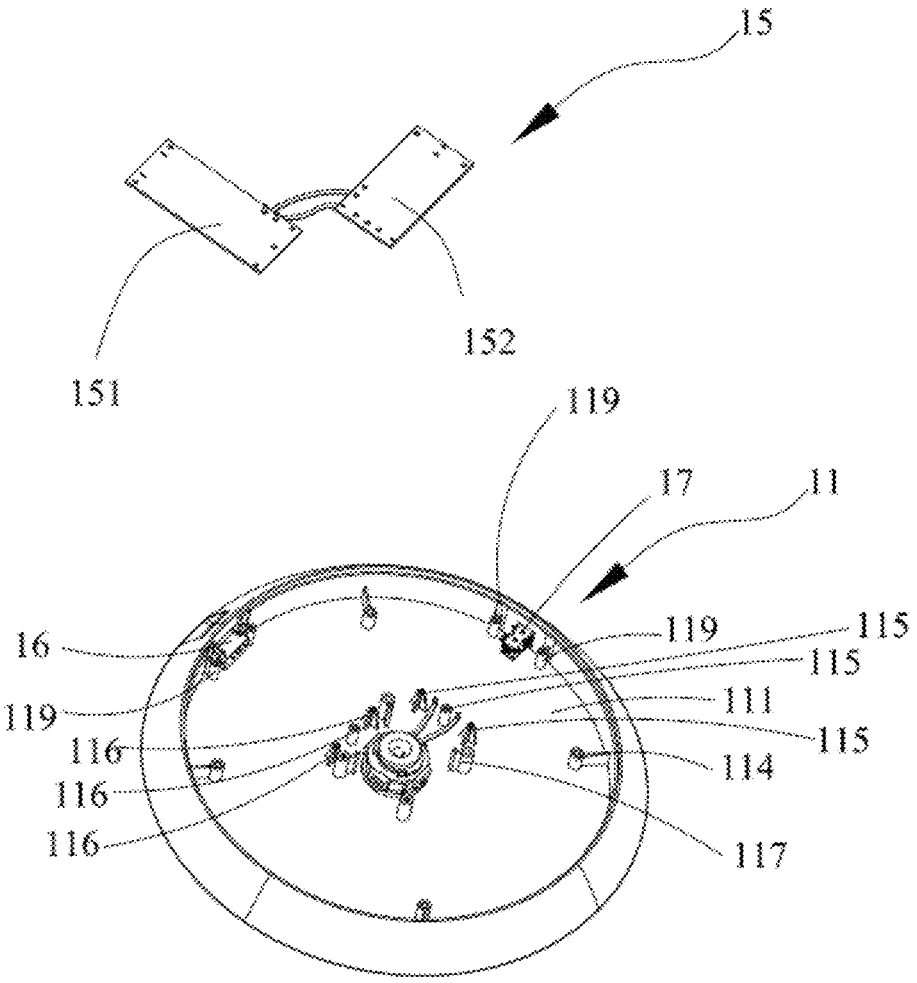
FIG. 37 is an exploded diagram of the base of the illuminating apparatus shown in FIG. 26, including a circuit board of the illuminating apparatus.

Referring to FIG. 35, the illuminating apparatus further includes a lamp post rotating assembly 90. The lamp post rotating assembly 90 is accommodated in the base 10 and coupled to the lamp post 20. Referring to FIG. 26, the base 10 includes a bottom shell 11, a base plate 12, a washer 13, a counterweight 14, a circuit board 15, and a lamp post rotating assembly 90. The base plate 12 is fixed to a bottom of the bottom shell 11. The counterweight 14 is located in the bottom shell 11. The washer 13 is attached to a bottom of the base plate 12. The circuit board 15 is received in the bottom shell 11. Referring to FIG. 37, the circuit board 15 includes a first circuit board 151 and a second circuit board 152 electrically coupled to the first circuit board 151.

Referring also to FIGS. 26 and 37, the base plate 12 is a circular plate body, and includes four studs 121 located on a periphery of one surface thereof. The bottom shell 11 has a disk shape and includes an opening 111. Four positioning columns 114 are formed above the opening 111. The four positioning columns 114 are arranged along a circumference of the opening 111. The four positioning columns 114 are used to be inserted into the stud 121 of the base plate 12, and are fixed by screws so that the base plate 12 covers and fixes to the opening 111 of the bottom shell 11. The base plate 12 has a central district 122. The bottom shell 11 includes a plurality of first positioning columns 115, a plurality of second positioning columns 116, a plurality of third positioning columns 117, an output interface 17, and an input interface 16. The lamp post rotating assembly 90 is mounted at a center of the base plate 12. In detail, the plurality of first positioning columns 115 are arranged at intervals on a side of a center position of the base plate 12. There are three second positioning columns 116, which are disposed on the side of the center position of the base plate 12 and adjacent to the first positioning column 115. There are four third positioning columns 117, centered around the center position of the base plate 12 and located at four corners of the rectangle. The output interface 17 and the input interface 16 each includes a fixed column 119 at its edge. The first circuit board 151 is electrically coupled to the input interface 16. The illuminating apparatus charges a battery of the first lamp holder 50 via the input interface 16. The second circuit board 152 is electrically coupled to the output interface 17. The output interface 17 is a standard USB, Mini USB, type C interface, etc., and can be coupled to various electronic devices such as a mobile phone, a pad, etc., so that the illuminating apparatus charges these electronic devices. The first positioning columns 115 are used for fixing the first circuit board 151. The second positioning columns 116 are used for fixing the second circuit board 152. The third positioning columns 117 are used for fixing the support plate of the lamp post rotating assembly 90.

Figure 36:
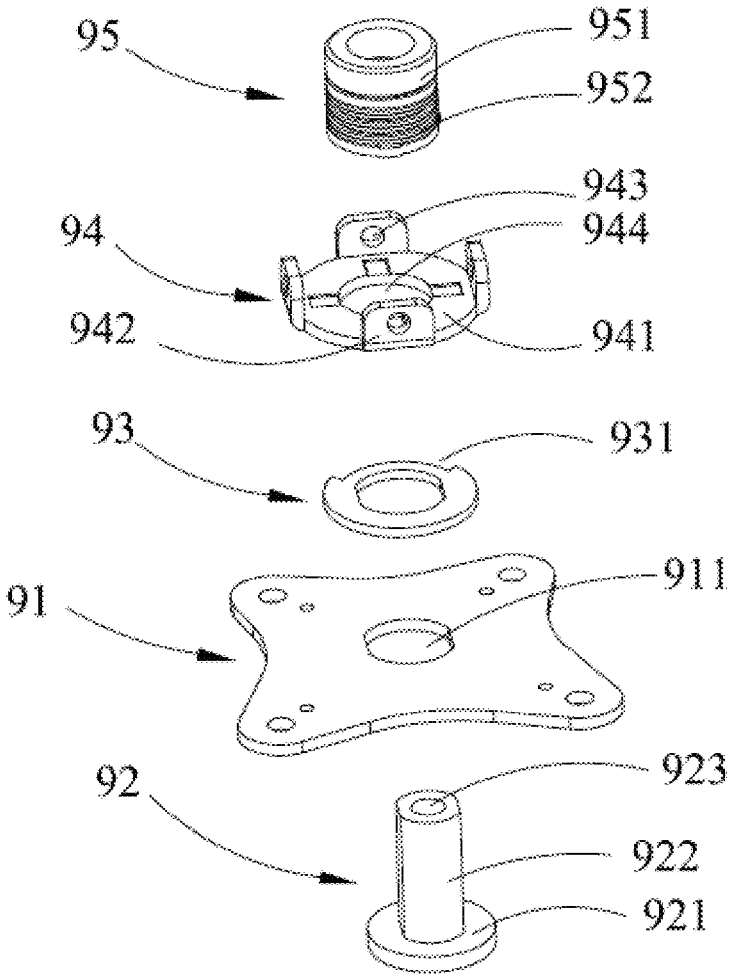
FIG. 36 is an exploded diagram of the lamp post rotating assembly shown in FIG. 35.

Referring to FIGS. 35 and 36, the lamp post rotating assembly 90 includes a support plate 91, a fixing member 92, a spacer 93, and a support frame 94. The lamp post rotating assembly 90 includes a spring assembly 95 that is inserted through the fixing member 92 and pressed against the support frame 94. The fixing member 92 protrudes upward from the support plate 91, and the fixing member 92 abuts against the surface of the support plate 91 to prevent the fixing member 92 from falling off the support plate 91. The fixing member 92 is fixed to the surface of the support plate 91 by welding. The support frame 94 is located on the support plate 91, and the spacer 93 is located between the support frame 94 and the support plate 91. The spacer 93, the support frame 94 and the spring assembly 95 are sleeved on the fixing member 92. The support frame 94 can rotate relative to the support plate 91.

In detail, the support plate 91 is substantially a rectangular plate body, and a through hole 911 is defined in a middle thereof. The fixing member 92 includes a fixing plate 921 and a rod body 922 protruding from a surface of the fixing plate 921. The rod body 922 includes external threads. The spacer 93 is a circular ring-shaped sheet body and defines a limiting slot 931 at a side thereof. The support frame 94 includes a bump located toward a surface of the support plate 91. The bump is confined within the limiting slot 931 to limit a rotation angle of the lamp post rotating assembly 90. The support frame 94 includes a circular ring-shaped substrate 941, and four side plates 942 protruded from a peripheral side edge of the substrate 941. The four side plates 942 are oppositely disposed and each defines a through hole 943. Of course, the side plate 942 may includes a clasper or a stuck protrusion. Side plate 942 is perpendicular to the substrate 941. The area of the substrate 941 is smaller than the area of the support plate 91. There is a through hole 944 defined in a middle of the substrate 941. The through hole 911 and the through hole 944 are used to sleeve on the rod body 922. The bottom surface of the substrate 941 of the support frame 94 is formed with bumps, and the bumps are limited to be movable only in the limiting slot 931 to limit the rotation angle of the lamp post rotating assembly 90. The spring assembly 95 includes a cylinder top ring 951 and a spring 952 sleeved around the top ring 951. The spring 952 is compressed between the top ring 951 and the support frame 94 to increase a rotational damping of the support frame 94. An inner circumferential surface of the top ring 951 has an internal thread for connecting with the external thread of the rod body 922.

The support plate 91, the spacer 93, and the support frame 94 are sleeved on the rod body 922 of the fixing member 92. The top ring 951 of the spring assembly 95 is screwed on the rod body 922 to lock the spacer 93 and the support frame 94 on the support plate 91. The top ring 951 clamps the spring 952 between the spacer 93 and a protruding periphery of the top ring 951. The fixing member 921 of the fixing member 92 is welded to a bottom surface of the support plate 91, and the support plate 91 is fixed inside the bottom shell 11. The third positioning column 117 is used to support the support plate 91. The metal cylinder 26 of the lamp post 20 is mounted on the bottom shell 11 with the pipe 25. The ring edge of the pipe 25 is sleeved on the top ring 951. The through holes of the pipe 25, and the through holes 261 of the metal cylinder 26 are aligned with the through holes 943 of the side plate 942 of the support frame 94, and are fastened by screws, thereby fixing the lamp post 20 to the lamp post rotating assembly 90.

The support frame 94 can rotate relative to the support plate 91 centered on an axis of the support plate 91, thereby driving the lamp post 20 to rotate. When the first lamp holder 50 is rotated in the horizontal plane, the metal cylinder 26, the pipe 25, and the support frame 94 are rotating together around a stem 922 of the fixing member 92. The fixing member 92, the support plate 91, and the bottom shell 11 do not rotate. Further referring to FIG. 39, the edge of the central hole 112 of the bottom shell 11 also forms a limiting ring 19 protruding downwards. The limiting ring 19 abuts a top of the side plate 942 of the support frame 94, and the lamp post 20 is inserted into the center hole 112 and is bounded by the limiting ring 19. It is surrounded to prevent the support frame 94, the metal cylinder 26, and the pipe 25 from being pulled out from the center hole 112 of the bottom shell 11.

When the top ring 951 is rotated downwards, the fixing member 92 and the support plate 91 are not moved, the spring 952 of the spring assembly 95 is compressed, resulting in the spring 952 exerting an increased elastic force on the support frame 94 and increasing the damping of the rotation of the support frame 94, so as to adjust the rotation damping of the lamp post rotating assembly 90. The spacer 93 is located between the substrate 941 of the support frame 94 and the support plate 91. The area of the spacer 93 is smaller than the area of substrate 941 and the support plate 91. The spacer 93 is used to reduce a rotational friction of the support frame 94 relative to the support plate 91 so as to prevent the wear from being caused by excessive friction.

Figure 39:
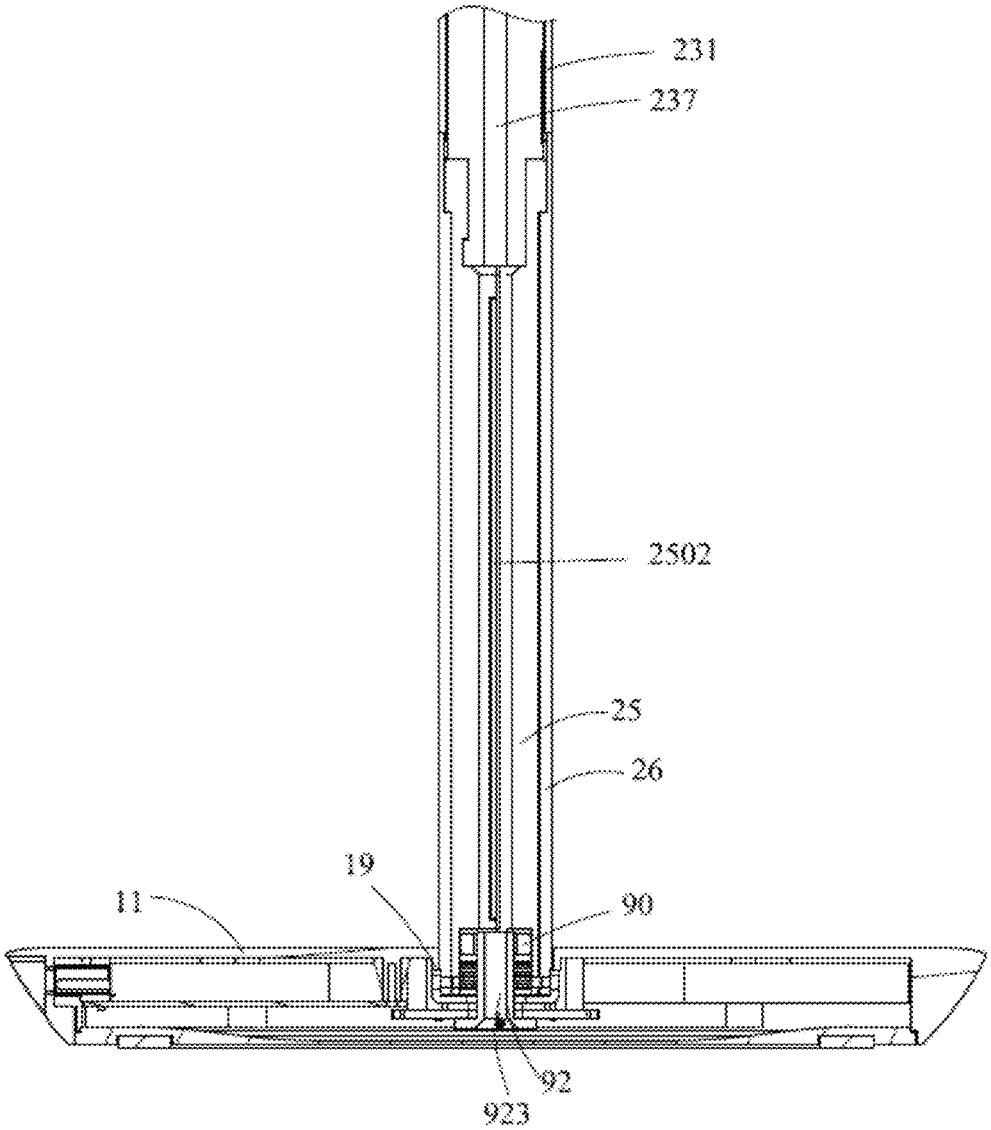
FIG. 39 is a schematic and plan diagram of a connecting structure that the touch segment and the support segment of the lamp post of the illuminating apparatus are coupled to each other through the lamp post rotating assembly and the base.

Referring to FIG. 39, the illuminating apparatus further includes a wire structure including a first wire coupling the first lamp holder 50 and a second wire coupling the second lamp holder 70. The first wire and the second wire all pass through a head of the rotating head 81, and couple with the second control module (ie, the aforementioned control module) for providing power to the first lamp holder 50 and the second lamp holder 70. The first wire passes through the groove 815. The second wire passes through the threading hole 816. The threading hole 816 approaches the groove 815. The wire structure also includes wires coupled to the second control module. The wires enter the base 10 through the touch segment 23 and the support segment.

In detail, the first wire passes through the through slot 315 of the connecting segment 35 of the stand 30, the groove 815 of the rotating head 81, an inside of the pipe 21 of the lamp post 20, and is then electrically coupled to the circuit board 27 within the pipe 21. The second wire passes through the through slot 335 of the connecting segment 35 of the stand 30, the threading hole 816 of the rotating head 81, the inside of the pipe 21 of the lamp post 20, and is electrically coupled to the circuit board 27 within the pipe 21. After that, the wire extends from the circuit board through the through hole 237 of the transparent pipe 231 and the channel 2502 of the pipe 25, and then enters the inside of the bottom shell 11 from the center hole 923 of the fixing member and is electrically coupled to the first circuit board 151 and the second circuit board 152 of the circuit board 15.

Wherein, the threading hole 816 is close to the groove 815 and is separated from the groove 815. There are several reasons why the wires of the first lamp holder 50 and the second lamp holder 70 are respectively passing through the separate groove 815 and the threading hole 816 without passing through the groove 815 at the same time. Firstly, the number of the wires coupling with the first lamp holder 50 and the second lamp holder 70 is very large. If they are mixed together through the groove 815, it is difficult to distinguish whether they are electrically coupled to the first lamp holder 50 or the second lamp holder 70 in the later lineup, which is likely to cause confusion. Therefore, the wires coupling the first lamp holder 50 are inserted in the groove 815, and the wire coupling the second lamp holder 70 are threaded in the threading hole 816 to avoid confusion.

Secondly, the groove 815 also has a function of threading the inserted rod 86, and the inserted rod 86 moves left to right in the groove 815. If the wires coupling the second lamp holder 70 also pass through the groove 815 and the second lamp holder 70 are on the left side of the groove 815, the wires coupling the second lamp holder 70 also need to pass through the left side of the groove 815. However, since the space reserved for the left side of the groove 815 is small, if the wires coupling the second lamp holder 70 pass through the groove 815, the inserted rod 86 will press against the wires coupling the second lamp holder 70 when moving to the left, and repeatedly press for a long time, it will cause damage to the wires.

Thirdly, if the left side of the groove 815 is elongated, the reserved space on the left side of the groove 815 becomes larger, so that the inserted rod 86 does not press against the wires coupling the second lamp holder 70 when they are active. However, a consequence is that when the first lamp holder 50 is rotated downwards, the left side of the groove 815 is too long to be exposed by the stand 30, thereby affecting an appearance of the illuminating apparatus. And the left side of the exposed groove 815 is also susceptible to dust, water vapor, and other impurities, affecting the use of the illuminating apparatus.

Referring to FIG. 23, in detail, the first control module is provided on the first circuit board 531 of the first lamp holder 50 to control several LED lights. The light source, the switch 562 and the first control module are coupled by wires. The first control module can work alone after the first lamp holder 50 is pulled out, or it can work together with the second control module on the circuit board 27 in the lamp post 20 after the first lamp holder 50 is inserted.

After the first lamp holder 50 is inserted, the first control module is electrically coupled to the joint 36 in the stand 30 through the interface 552 of the first lamp holder 50. The joint 36 of the stand 30 and the second control module in the lamp post are electrically coupled through the aforementioned wires coupling the first lamp holder 50. In the second lamp holder 70, the circuit board of the LED module 72 and the second control module in the lamp post 20 are electrically coupled by the aforementioned wire coupling the second lamp holder 70.

The circuit board 27 accommodated in the pipe 21 of the lamp post 20 is a control circuit board, and the second control module is provided on a circuit board 27. The wires connecting the first lamp holder 50 and the second lamp holder 70 pass through the opening on the top of the pipe 21 and are coupled to the circuit board 27. The circuit board 27 is also electrically coupled to the flexible touch panel 230 wrapped on the outside of the transparent pipe 231 through a flexible circuit board.

After the first lamp holder 50 is inserted, the battery in the first lamp holder 50 powers the second control module of the lamp post 20, the flexible touch panel 230, and the second lamp holder 70. Of course, an external power supply may be inserted into the interface 16 of the base 10 to supply power.

When the interface of the first lamp holder 50 is inserted into the stand 30, the second control module is electrically coupled to the first control module. The second control module is used to control the brightness of the first lamp holder 50 and the second lamp holder 70 according to the touch gesture sensed by the flexible touch panel. For example, if the single finger slides down from above, the brightness of the first lamp holder 50 is decreased. When the brightness of the first lamp holder 50 is reduced to be off, the second lamp holder 70 is automatically turned on. When the single finger slides upward again from the bottom, the second lamp holder 70 goes out, and the first lamp holder 50 gradually becomes bright. For another example, the sliding down of the two fingers is to adjust the color temperature of the first lamp holder 50.

The second control module is a central control module of the illuminating apparatus, which is put into the lamp post 20 to help save the overall volume, so as to avoid occupying the space within the base 10 and affecting the placement of the circuit board 15. The second control module includes an upper area of the lamp post 20 (ie, the flexible touch panel mentioned above) due to the large number of wires extending from the second lamp holder 70 and the first lamp holder 50 into the lamp post, if the second control module is located in the lower area of the lamp post 20 (that is, underneath the flexible touch panel). These wires must cross the circuit board 27 over a long distance. Such the long wires cause the first lamp holder 50 to be easily wound or even broken when rotated.

The above is a preferred embodiment of the present disclosure, and it should be noted that those skilled in the art may make some improvements and modifications without departing from the principle of the present disclosure, and these improvements and modifications are also the protection scope of the present disclosure.

What is claimed is:

1. A lamp holder rotating assembly, comprising a foundation support, an inserted rod and a rotating head, wherein the foundation support defines a locating slot, the inserted rod comprises a head end and a tail end coupled to the head end, the rotating head defines a groove, the inserted rod is rotatably mounted on the foundation support, the tail end passes through the locating slot, the head end passes through the groove of the rotating head, the head end rotates in the groove along a first direction which causes the tail end rotating in the locating slot along a second direction opposite to the first direction.

2. The lamp holder rotating assembly according to claim 1, wherein the foundation support comprises a fixing member, and the fixing member couples the inserted rod to the foundation support and a rotation of the inserted rod relative to the foundation support is realized.

3. The lamp holder rotating assembly according to claim 2, wherein the foundation support comprises a base plate, and the locating slot is defined on the base plate, the base plate comprises a support chip, the fixing member comprises a rod body that passes through the tail end of the inserted rod and the support chip.

4. The lamp holder rotating assembly according to claim 3, wherein the rod body comprises a head end and a connecting rod, and the fixing member further comprises a spring sleeved on the connecting rod of the rod body, and the spring is compressed on the rod body of the head end and the inserted rod.

5. The lamp holder rotating assembly according to claim 4, wherein the fixing member further comprises a nut sleeved on the connecting rod, and the support chip is located between the nut and the tail end of the inserted rod.

6. The lamp holder rotating assembly according to claim 4, wherein an outer peripheral surface of the connecting rod comprises a flat surface, the support chip defines a through hole through which the connecting rod is inserted, and an inner peripheral surface of the through hole forms a flat surface, when the connecting rod is passed through the through hole of the support chip, the two flat surfaces abut to limit a rotation of the connecting rod relative to the support chip.

7. The lamp holder rotating assembly according to claim 4, wherein the fixing member further comprises a spacer sleeved on the connecting rod, and the spacer is located between the tail end and the support chip.

8. The lamp holder rotating assembly according to claim 2, wherein the foundation support comprises a base plate, and the locating slot is disposed on the base plate, and the base plate comprises two support chips located on two ends of the locating slot, the fixing member comprises a shaft and a torsion spring installed on the shaft, the tail end is sleeved on the shaft, two ends of the shaft are rotated and mounted on the two support chips, two ends of the torsion spring abut one of the support chips and the tail end.

9. The lamp holder rotating assembly according to claim 1, wherein the tail end abuts opposite side edges of the locating slot respectively when the tail end rotates within the locating slot to limit a rotation angle of the inserted rod.

10. The lamp holder rotating assembly according to claim 9, wherein the tail end also defines an avoidance slot, and the inserted rod is vertically disposed when the tail end abuts one side edge of the locating slot, the inserted rod is obliquely disposed when the tail end abuts other side edge of the locating slot.

11. The lamp holder rotating assembly according to claim 1, wherein the rotating head comprises a neck and a head at one end of the neck, the groove is located at the head, and the foundation support is received in the neck.

12. The lamp holder rotating assembly according to claim 11, wherein an inner surface of the head comprises fixed columns, and the foundation support is fixedly coupled to the fixed column through a locking member.

13. The lamp holder rotating assembly according to claim 11, wherein the groove is offset from a center axis of the head.

14. The lamp holder rotating assembly according to claim 11, wherein the lamp holder rotating assembly further comprises a stand having a connecting segment for connecting a lamp holder.

15. The lamp holder rotating assembly according to claim 14, wherein the connecting segment defines a through slot, a slot is formed in a bottom wall of the through slot, and the rotating head is accommodated in the through slot, the head end of the inserted rod is inserted into the slot and fixed.

16. The lamp holder rotating assembly according to claim 15, wherein the head of the rotating head is hemispherical, and the through slot is hemispherical.

17. The lamp holder rotating assembly according to claim 15, wherein opposite sides of the head end of the inserted rod define two oppositely inclined screw holes respectively, and inner side of the slot defines two through holes corresponds to the two screw holes respectively.

18. An illuminating apparatus, wherein, the illuminating apparatus comprises a base, a lamp post mounted on the base, a lamp holder, and a lamp holder rotating assembly according to any one of claim 1, the lamp holder is rotatably mounted on the lamp post through the lamp holder rotating assembly.

* * * * *